US012247364B2

(12) United States Patent
Shany et al.

(10) Patent No.: US 12,247,364 B2
(45) Date of Patent: Mar. 11, 2025

(54) SELF-EXPANDING SPILL CONTAINMENT BOOM

(71) Applicant: HARBO Technologies Ltd., Bnei-Brak (IL)

(72) Inventors: Arnon Shany, Moshav Neve Yarak (IL); Boaz Ur, Tel-Aviv (IL); Haim Greenberg, Ramat-Gan (IL)

(73) Assignee: HARBO Technologies Ltd., Bnel-Brak (IL)

( * ) Notice: Subject to any disclaimer, the term of this patent is extended or adjusted under 35 U.S.C. 154(b) by 103 days.

(21) Appl. No.: 18/015,103

(22) PCT Filed: Jul. 6, 2021

(86) PCT No.: PCT/IL2021/050832

§ 371 (c)(1),
(2) Date: Jan. 9, 2023

(87) PCT Pub. No.: WO2022/009205

PCT Pub. Date: Jan. 13, 2022

(65) Prior Publication Data

US 2023/0313478 A1 Oct. 5, 2023

Related U.S. Application Data

(60) Provisional application No. 63/048,695, filed on Jul. 7, 2020.

(51) Int. Cl.
*E02B 15/06* (2006.01)
*E02B 15/08* (2006.01)

(52) U.S. Cl.
CPC ..... *E02B 15/0807* (2013.01); *E02B 15/06* (2013.01); *E02B 15/0814* (2013.01);
(Continued)

(58) Field of Classification Search
CPC .. E02B 15/06; E02B 15/0892; E02B 15/0885; E02B 15/0864; E02B 15/0857;
(Continued)

(56) References Cited

U.S. PATENT DOCUMENTS 3,665,713 A * 5/1972 Rath ..... E02B 15/0828 210/924
3,740,955 A 6/1973 Fossberg
(Continued)

FOREIGN PATENT DOCUMENTS

GB 1480258 A * 7/1977 ..... E02B 15/048
WO WO 2008/023094 2/2008
(Continued)

OTHER PUBLICATIONS

Supplementary European Search Report and the European Search Opinion Dated Dec. 18, 2023 From the European Patent Office Re. Application No. 21837114.4. (10 Pages).
(Continued)

*Primary Examiner* — Frederick L Lagman

(57) ABSTRACT

Some embodiments relate to a boom for containing floating material spilled in water comprising: an elongate sheet comprising a plurality of spaced apart units, each unit configured to self-expand from a folded state upon deployment; each unit comprising: a plurality of plates forming an upper portion and a lower portion, the upper portion and the lower portion defined along a vertical axis of the boom unit; and a plurality of stiffening elongate rods, each of the plurality of elongate rods interconnecting at least two plates.

27 Claims, 18 Drawing Sheets

(52) U.S. Cl.
CPC ..... *E02B 15/0864* (2013.01); *E02B 15/0871* (2013.01); *E02B 15/0885* (2013.01); *E02B 15/0892* (2013.01)

(58) Field of Classification Search
CPC ..... E02B 15/0814; E02B 15/0807; E02B 15/0871
USPC ..... 405/63, 66, 68, 69, 71
See application file for complete search history.

(56) References Cited

U.S. PATENT DOCUMENTS

| | | | | | |
|---|---|---|---|---|---|
| 3,744,253 | A | * | 7/1973 | Williams | E02B 15/08 405/66 |
| 3,757,526 | A | * | 9/1973 | Larsson | E02B 15/08 405/72 |
| 3,798,911 | A | * | 3/1974 | Oberg | E02B 15/08 405/69 |
| 3,852,978 | A | * | 12/1974 | Fossberg | E02B 15/0814 405/72 |
| 3,901,753 | A | | 8/1975 | Oeberg | |
| 4,188,155 | A | * | 2/1980 | Langermann | E02B 15/08 405/63 |
| 4,330,223 | A | | 5/1982 | Webb | |
| 5,173,008 | A | * | 12/1992 | Thorell | E02B 15/0842 405/63 |
| 5,695,300 | A | * | 12/1997 | Echols | E02B 15/08 405/63 |
| 5,860,252 | A | * | 1/1999 | Oberg | E02B 15/0814 92/52 |
| D858,689 | S | | 9/2019 | Shany et al. | |
| 10,753,057 | B1 | * | 8/2020 | Sokolowski | E02B 3/108 |
| 2017/0233967 | A1 | | 8/2017 | Shany et al. | |
| 2017/0306580 | A1 | | 10/2017 | Shany et al. | |
| 2020/0181863 | A1 | | 6/2020 | Shany et al. | |

FOREIGN PATENT DOCUMENTS

| | | |
|---|---|---|
| WO | WO 2019/021272 | 1/2019 |
| WO | WO 2022/009205 | 1/2022 |

OTHER PUBLICATIONS

International Preliminary Report on Patentability Dated Jan. 10, 2023 From the International Bureau of WIPO Re. Application No. PCT/ IL2021/050832. (5 Pages).

International Search Report and the Written Opinion Dated Oct. 14, 2021 From the International Searching Authority Re. Application No. PCT/IL2021/050832. (10 Pages).

* cited by examiner

SELF-EXPANDING SPILL CONTAINMENT BOOM

RELATED APPLICATIONS

This application is a National Phase of PCT Patent Application No. PCT/IL2021/050832 having International filing date of Jul. 6, 2021, which claims the benefit of priority under 35 USC § 119 (e) of U.S. Provisional Patent Application No. 63/048,695 filed Jul. 7, 2020. The contents of the above applications are all incorporated herein by reference as if fully set forth herein in their entirety.

FIELD AND BACKGROUND OF THE INVENTION

The present invention, in some embodiments thereof, relates to a spill containment boom, and, more particularly, but not exclusively, to a boom structure supported by rigid elongate elements.

U.S. Pat. No. 3,901,753A to Per Olof Oberg discloses "A method of producing a buoyant boom made of a flexible material impermeable to water and air. An elongated sheet of the flexible material is initially disposed in an unfolded position. The sheet has first and second portions disposed adjacent the opposite edges and extending longitudinally thereof, which first and second portions are separated by an intermediate portion. Expander devices are attached to the first and intermediate portions of the sheet at spaced intervals therealong, and pieces of flexible material are also disposed on said sheet at spaced intervals between the expander devices so as to extend transversely across the first and intermediate portions. The pieces are sealed along one edge thereof to said first and second portions in a direction transversely thereof. The first portion of the sheet is then folded to overlap the intermediate portion, which also causes a folding over of the pieces. The first portion is then sealed adjacent the free edge thereof to said intermediate portion to form a hoselike expandable portion, and the free edges of the pieces are also sealed together to form liquid-tight partitions which extend across the hoselike portion and divides same into chambers. The second edge portion of the sheet is permitted to freely extend from the hoselike portion to form a depending curtain."

SUMMARY OF THE INVENTION

According to an aspect of some embodiments there is provided a boom for containing floating material spilled in water comprising:

- an elongate sheet comprising a plurality of spaced apart units, each unit configured to self-expand from a folded state upon deployment; each unit comprising:
- a plurality of plates forming an upper portion and a lower portion, the upper and lower portions defined along a vertical axis of the boom unit; and
- a plurality of stiffening elongate rods, each of the elongate rods interconnecting at least two plates.

In some embodiments, the elongate rods extend along a vertical plane of the boom unit.

In some embodiments, plates of the lower portion of the unit are arranged to define a crossing between them, and the elongate rods pass at the crossing.

In some embodiments, a pair of adjacent elongate rods are positioned to define a vertically oriented X shape.

In some embodiments, when the boom is deployed in water, the upper portion floats above water surface and the lower portion remains substantially below water surface.

In some embodiments, the elongate rods are formed of metal and/or fiberglass.

In some embodiments, the elongate rods are arranged in a staggered configuration, aligned side by side in a folded state of the boom unit.

In some embodiments, elongate rods which together define the X shape are disposed on parallel vertical planes.

In some embodiments, elongate rods which together define the X shape are disposed on a similar plane.

In some embodiments, elongate rods are sufficiently heavy so as to at least partially ballast the boom unit.

In some embodiments, wherein one or more of the elongate rods includes a segment which is folded over another segment of the rod, thereby increasing a weight of the rod locally at the folded segment.

In some embodiments, the folded segment is configured at the lower portion of the boom unit.

In some embodiments, at least some of the plates are arranged to form a hollow chamber in an expanded state of the unit.

In some embodiments, the hollow chamber comprises a rhombus cross section shape.

In some embodiments, the elongate rods cross at a lowest point of the rhombus.

In some embodiments, each of the units comprises an elastic element positioned and configured to actuate expansion of the unit.

In some embodiments, adjacent elongate rods are configured to pivot about their crossing during expansion of the boom unit.

In some embodiments, at least some of the plates are arranged to form a hollow chamber in an expanded state of the unit; and the elastic element extends between plates which define opposing faces of the hollow chamber or between opposing coupling points of adjacent plates.

According to an aspect of some embodiments there is provided a boom for containing floating material spilled in water comprising:

- an elongate sheet comprising a plurality of spaced apart units, each unit comprising a plurality of plates arranged to define a hollow chamber in an expanded state of the unit, each unit comprising:
  - an upper portion configured to remain substantially above the water surface when the boom is deployed;
  - a lower portion configured to remain substantially below the water surface when the boom is deployed, the lower portion comprising a plurality of vertically oriented rigid elongate rods; and
  - an elastic element extending across the hollow chamber.

In some embodiments, the elastic element is positioned and configured to actuate expansion of at least the upper portion.

In some embodiments, the elastic element is a spring.

In some embodiments, the elastic element is extended at a folded state of the boom unit and returns to a natural rest state at an expanded state of the boom unit.

In some embodiments, pairs of elongate rods are arranged to cross each other.

In some embodiments, expansion of the upper portion by the elastic element causes movement of the elongate rods relative to each other.

In some embodiments, the upper portion comprises sealed air cells.

In some embodiments, the sealed air cells are in the form of a closed-cell foam or in the form of pre-filled welded cells.

According to an aspect of some embodiments there is provided a method for containing floating material spilled in water comprising:

detecting a spill;

providing a boom sleeve comprising a plurality of units, each unit comprising an upper portion and a lower portion, the lower portion comprising stiffening elongate rods;

deploying the boom sleeve to surround the spill; wherein deploying comprises allowing each unit to self-expand in response to spring-based actuation which expands the upper portion, thereby causing expansion of the lower portion.

In some embodiments, the stiffening elongate rods extend to a coupling point with a plurality of plates of the upper portion, so that when the spring based actuation moves plates of the upper portion, the rods are moved in response.

In some embodiments, following deployment of the boom sleeve each of the units remains afloat by a plurality of sealed air cells, and ballasted by one or more of: weights, water entering open cells and/or chambers of the boom.

According to an aspect of some embodiments there is provided a boom for containing floating material spilled in water comprising:

an elongate sleeve comprising a plurality of spaced apart units, each unit comprising:

an upper portion comprised of plates lighter than water;

a lower portion comprising stiffening elongate elements positioned and configured to rigidify and ballast the boom unit.

In some embodiments, each of the upper portion plates comprises an array of sealed, pre-filled air cells.

In some embodiments, each of the upper portion plates comprises closed cell sponge.

In some embodiments, the lower portion is comprised of a plurality of plates, the elongate elements at least partially embedded or mounted onto the plates.

In some embodiments, the lower portion further comprises a plurality of weights.

In some embodiments, the lower portion further comprises a plurality of weights, the weights shaped as short rods positioned embedded or mounted onto the plates.

In some embodiments, the upper portion comprises an elastic element positioned and configured to actuate expansion of the boom unit upper portion which thereby causes expansion of the lower portion.

In some embodiments, the boom comprises one or more axially extending supporters which pass along a length of the elongate sleeve.

In some embodiments, the one or more axially extending supporters comprise flexible, tear-resistant straps.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF SPECIFIC EMBODIMENTS OF THE INVENTION

Figure 1A:
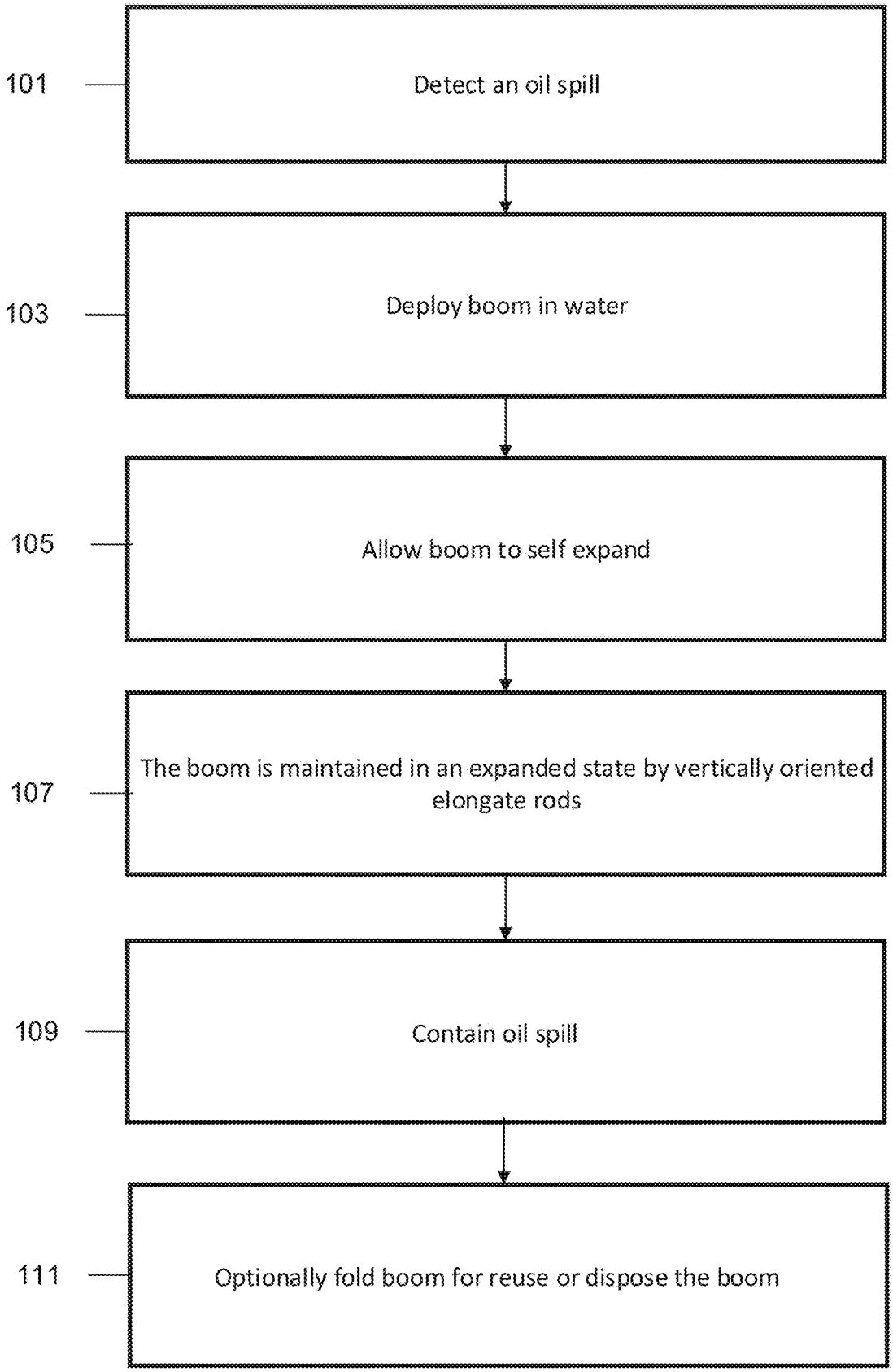
FIG. 1A is a flowchart of a general method for containing an oil spill, according to some embodiments.

The present invention, in some embodiments thereof, relates to a spill containment boom, and, more particularly, but not exclusively, to a boom structure supported by rigid elongate elements.

In some embodiments, the boom is stored in a folded state and self-expands when deployed. In some embodiments, the expanded boom is supported by a plurality of rigid and/or semi-rigid structural elements.

An aspect of some embodiments relates to a boom unit which structure is rigidified and stabilized with the aid of elongate rigid elements, such as elongate rods or beams. In some embodiments, in a deployed, expanded boom unit, the rods lie within a vertical plane of the boom unit, the vertical plane being substantially perpendicular to the water surface. Additionally or alternatively, elongate rods lie within a horizontal plane of the boom unit, for example, in a direction parallel to a long axis of the long boom sleeve.

In some embodiments, a boom unit is constructed of plates, and the elongate elements are embedded within and/or mounted onto the plates. In some embodiments, the elongate elements interconnect at least two plates to each other. Optionally, the elongate element extends to interconnect the two plates along a vertical plane of the boom unit. In some embodiments, plates of the expanded boom unit define planes that are diagonal to (e.g. at an angle to) a horizontal plane defined by the water surface and/or to a vertical plane defined by the floating boom unit as a whole.

In some embodiments, the elongate elements are stiffer than the plates, for example, are more resistant to bending than the plates. In some embodiments, the plates are resilient and are configured to return to relaxed configuration (e.g. a planar, spatial layout) following applying of force.

In some embodiments, the plates are positioned to form a crossing (optionally both in the folded and expanded configuration), and the elongate elements (e.g. rods) pass at the crossing. In some embodiments, for example during unfolding, the elongate elements are configured to move with respect to each other. Optionally, an angle between rods (e.g. between a pair of rods) is easily reconfigurable, for example by moving (e.g. pushing apart) plates to which the rods are connected.

In some embodiments, elongate elements in the form of rods are arranged in pairs, each pair defining an X-shape in which diagonally-extending rods cross each other. In some embodiments, in a deployed boom, the X-shape remains substantially under water surface. Some potential advantages of an X-shape may include improving a rigidity of at least a portion of the boom unit (e.g. a lower portion of the boom unit); improving a resistance of the boom unit to externally acting forces, such as forces caused by winds, waves and/or current; improving a resistance of the boom unit to being pulled out of the water, for example due to the upside down V shape formed by the crossing rods; resisting collapsing of the boom unit (for example, reducing a likelihood of the boom unit to collapse back to its folded state when deployed).

In some embodiments, plates which form walls of the boom unit include an array of cells. Optionally, each rod is at least partially received within a cell. In some embodiments, the rods are arranged in staggered configuration within the cells (for example so that rods of a pair which form the X shape are arranged on parallel planes); alternatively, rods of a pair which form the X-shape are positioned directly across each other, on the same plane.

In some embodiments, a rod extends between two plates of a lower portion of the boom unit, interconnecting the plates. In some embodiments, a first rod segment is received with a cell of a first plate, a second (middle) rod segment is at least partially exposed, and a third rod segment is received within a cell of second plate. Optionally, the first and second plates are arranged, in the expanded boom, on a similar diagonally oriented plane. In some embodiments, the crossing point of the rod with a paired rod (which together form the X-shape) is located at the exposed middle segment of the rod.

In some embodiments, the elongate rods function as ballast, for example by being formed of a heavy material, such as metal. Additionally or alternatively, the boom unit comprises one or more weights for ballasting the boom unit. Optionally, the weights are shaped as short rods. Optionally, weights are disposed in a vertical orientation (e.g. on a plane similar or parallel to the vertical plane along which the elongate rods are disposed). In some embodiments, the boom unit is ballasted by one or more of: the elongate rods, weights, and water, e.g. water entering open cells and/or open spaces (e.g. a hollow chamber) defined by the expanded boom unit. The open cells and/or spaces may be configured above water and/or below water in the deployed boom unit. In some embodiments, an elongate rod functions both as a structural rigidifying element and as a ballast. In an example, an elongate rod comprises a curved or bent segment. Optionally, the bent segment is folded over another segment of the rod, forming a "double stranded" rod portion. In some embodiments, the bent segment is located at a lower portion of the rod, so that the rod may act as a ballast having a low center of gravity. In some embodiments, the bent (e.g. folded) segment forms a heavier portion of the rod, for example at a selected location along the length of the rod. In some embodiments, the bent (e.g. folded) segment defines a rounded or curved edge which may reduce or prevent tearing or piercing of the boom sheet by the rod.

An aspect of some embodiments relates to a self-expanding boom unit, in which self-expansion of a boom unit portion generates expansion of another boom unit portion. In some embodiments, an elastic element such as a spring actuates expansion of a boom unit portion, such as an upper portion of the boom unit. (As used herein, the term "upper portion" of the boom unit may include a part of the boom unit, as viewed in cross section, which remain substantially above water level when the boom is deployed; and the term "lower portion" of the boom unit may include parts of the boom unit which remain substantially below water level when the boom is deployed. In some embodiments, the hollow chamber defined by the boom unit plates is positioned partially above water level, and partially below water level, so that water entering the chamber may fill up about a half of the volume of the chamber).

In some embodiments, the elastic element extends between opposing walls of the boom unit upper portion. In an example, walls (e.g. plates) of the boom unit are positioned such that a hollow chamber is formed in the expanded boom, for example, a rhombus shaped chamber, and the elastic element extends along the vertical and/or horizontal axis of the chamber. Additionally or alternatively, the elastic element extends between two rods, and/or between a rod and a plate.

In some embodiments, upon deployment, the elastic element bounces at least partially back to its natural rest state from an extended state, thereby pulling and/or pushing walls (e.g. plates) of the boom unit towards or away from each other. Due to that plates (and/or other structural elements of the boom such as the elongate rods) extend from the lower portion of the boom unit at least partially into the upper portion of the boom unit, movement of the plates actuated by the elastic element results in simultaneous movement of plate portions extending into the lower boom unit portion, thereby causing expansion of the lower portion. In some embodiments, mechanical energy stored in the extended spring (in the folded state of the boom) is translated into a pushing or pulling force which acts on the plates and/or on the rods, moving them away from each other or closer to each other (depending on the specific arrangement).

In some embodiments, the expanded boom unit is maintained afloat by closed air cells and/or closed cell sponge, optionally located within the boom unit upper portion. A potential advantage of closed air cells may include that active inflation is not required upon deployment, potentially reducing deployment time and complexity.

In some embodiments, an elongate boom sleeve which is comprised of multiple chained boom units includes at least one axially extending supporter, for example formed as a strap, rope or cable extending along the length of the boom sleeve. In some embodiments, the supporter is coupled (for example stitched, glued and/or otherwise attached) to an inner surface of the sheet covering the units and/or to other structural components forming the units (e.g. rods, plates).

A potential advantage of an axially extending supporter may include improving a resistance of the boom sleeve to forces acting on the sleeve, for example to forces acting locally at a point along the length of the sleeve which may tear, cut or otherwise damage the sleeve. In some embodiments, the axially extending supporter is configured and positioned to distribute the locally acting forces along at least a portion of the sleeve length. In some embodiments, the axially extending supporter acts as a backbone of the boom the sleeve, potentially increasing a tensile strength of the sleeve and the sleeve's durability under pulling forces acting on the sleeve.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Referring now to the drawings, FIG. 1A is a flowchart of a general method for containing an oil spill, according to some embodiments.

In some embodiments, an off-shore spill of a floating substance such as oil is detected (101). In some embodiments, to limit spread of the spill and potentially contain the spill, a boom is deployed in the water (103), around at least a portion of the spill.

In some embodiments, the boom is deployed from a deployment craft (e.g. a small vessel) which carries the boom to the spill site. In some embodiments, deploying involves unpacking the boom (e.g. from a cartridge). In some embodiments, deploying is by placing a first end of the boom sleeve in water adjacent the spill, and then placing the rest of the boom sleeve length along the edge of the spill.

In some embodiments, when unpacked (e.g. in water, but also on land) the boom is allowed to self-expand (105). In some embodiments, self-expansion is at least partially actuated by an elastic element, for example, a spring. In some embodiments, self-expansion does not involve any active filling with air and/or water.

A potential advantage of a self-expanding boom may include facilitating deployment and providing for rapid deployment. In some embodiments, deployment requires no machinery and can be carried out by only one or two crew members. Rapid deployment may reduce the spread of the spill over time. A potential advantage of a boom which comprises a folded, compact state may include reducing storage space and facilitating mobilization of the boom.

In some embodiments, the boom sleeve is comprised of multiple units which are interconnected by the sleeve material, for example, interconnected by a flexible sheet forming the sleeve (e.g. a polyethylene sheet, optionally multi-laminated). Upon expansion, each unit expands from a folded, optionally flat configuration into a deployed configuration.

In some embodiments, at least a portion of the unit expands due to pulling and/or pushing force exerted by an elastic element, such as a spring. In some embodiments, upon deployment, the elastic element transforms from a compressed or extended position to a resting position, thereby exerting force on boom unit portions, such as opposing boom unit plates. In some embodiments, expansion of a boom unit portion by the elastic element generates expansion of one or more additional boom unit portions by affecting the structure. For example, expansion of an upper unit portion due to spring-based actuation moves plates of the boom unit which in turn move plates of a lower unit portion. In some embodiments, elastic materials other than a spring may be used, such as a silicon strap or a silicon tube. In some embodiments, expansion and/or maintaining of the boom unit in an expanded state is assisted by shape memory materials, e.g. nitinol. Optionally, a spring for example as described herein is formed of a shape memory material.

In some embodiments, a boom unit comprises a plurality of plates attached to the sheet material forming the boom sleeve. In some embodiments, in an expanded configuration, the plates define a hollow, for example, a polygonal cross section structure including a hollow. In some embodiments, in use, the hollow is at least partially filled by air, and at least partially filled by water. In some embodiments, the hollow forms a chute which extends along the length of the boom sleeve.

In some embodiments, in the expanded configuration the boom plates define an upside down V-shape, where the ends of the V shape extend below the surface of the water. A potential advantage of an upside-down V configuration may include increasing a resistance of the boom unit to being pulled out of the water, for example due to wind acting on the floatation compartments and/or due to water currents.

In some embodiments, a structure of each of the expanded boom units is maintained in an expanded state at least partially due to elongate elements such as beams or rods (107). In some embodiments, the rods are shaped and positioned to support the boom unit structure, improving a rigidity of at least a portion of the boom unit. In some embodiments, the rods are shaped and positioned to stabilize the boom unit, potentially increasing resistance of the boom unit to externally acting forces such as forces caused by winds, waves and/or currents (which may cause, for example, tilting of the unit, pivoting of the unit, bending of the unit, folding of the unit, collapsing of the unit, raising of the unit above water level). In some embodiments, the rods are shaped and positioned to resist the boom from returning to a folded or otherwise collapsed state. In some embodiments, each of a plurality of rods is at least partially received within an elongate cell defined in a boom unit plate, where multiple cells form an array of side-by-side cells.

In some embodiments, the rods are vertically oriented, for example positioned along a vertical plane of the boom unit. When the boom is unpacked and deployed in water, the rods may extend in a substantially perpendicular orientation to the water surface.

Additionally or alternatively, rods are oriented horizontally, for example along a long axis of the boom sleeve.

In some embodiments, the rods are positioned to define an upside down V shape of the deployed boom unit. Optionally, during deployment, the rods are moved to a deployed position. In an example, expansion of a boom unit portion, such as expansion of an upper portion of the boom unit by spring based actuation causes movement of the rods to their deployed position. Such movement may include, for example, two or more rods moving with respect to each other, movement of rods with respect to boom unit plates or portions, movement of rods with respect to the water surface.

In some embodiments, the rods are rigid, for example formed of or comprise solid, firm materials such as fiberglass, metal, hardened plastic, composite material, or a combination thereof.

In some embodiments, the rods are formed of and/or comprise a material which is heavy enough to at least partially ballast the boom unit. In some embodiments, the boom is at least partially ballasted by rods and one or more weights. Optionally, a weight is shaped as a rod. In some embodiments, the boom is ballasted using materials heavier than water (e.g. metal). In some embodiments, one or more weights are positioned (e.g. embedded or attached to the boom plates) at a lowest point of the boom unit, thereby potentially contributing to ballasting the boom unit.

In some embodiments, the boom is ballasted at least partially by water, such as water flowing within the hollow and/or water contained in closed (e.g. vacuum formed) cells and/or in sponge material attached to one or more of the plates. In some embodiments, a material heavier than water (e.g. having a specific gravity>1) may be used as ballast. In an example, the boom unit contains a material which absorbs water such as a superabsorbent polymer (SAP). In some embodiments, water (e.g. water entering the boom unit hollow chamber) weighs down the boom, passively making it harder for the boom unit to be pulled out of the water, such as due to wind.

In some embodiments, buoyancy is provided by air cells, such as an array of closed (e.g. vacuum formed) air cells, closed cell foam.

In some embodiments, the expanded, deployed boom contains the spill (109). Optionally, a depth of the floating boom (as determined by the vertical length of the boom unit) prevents entrainment, which is leaking of the spill (e.g. an oil spill) under the boom. In an example, a depth of the boom unit (e.g. relative to the water surface) is between 10-50 cm, such as 20 cm, 35 cm, 45 cm or intermediate, longer or shorter distance below water surface.

In some embodiments, a length of the boom sleeve is long enough to prevent or reduce the oil from passing around the boom. In an example, the boom sleeve length is between 10 meters-100 meters, such as 15 meters, 50 meters, 75 meters or intermediate, longer or shorter length. In some embodiments, one or both ends of the boom sleeve include connectors for coupling one boom sleeve to another, to increase a total length of the boom sleeve.

In some embodiments, the boom is light enough to follow vertical movement of water, for example float on wave crests, potentially preventing waves from transferring oil over the floating boom. In some embodiments, the boom free-floats with the contained spill.

In some embodiments, following use (e.g. following containing of contaminated materials), the boom is disposed of. Alternatively, in some embodiments, the boom is folded to be optionally reused. Optionally, the boom is reused multiple times, for example for as long as the materials forming the boom last. Optionally, due to the use of durable elastic elements such as springs, the boom can be expanded and folded over and over again.

Figure 1B:
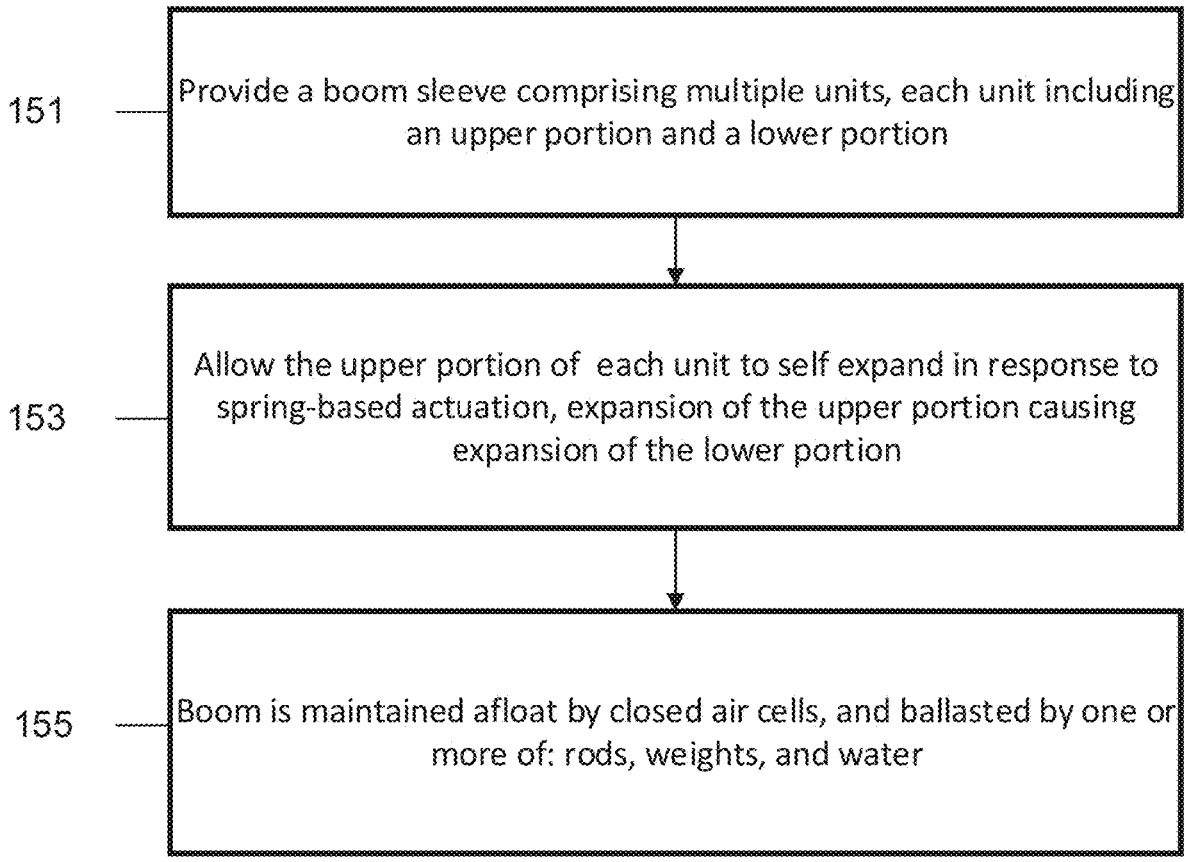
FIG. 1B is a flowchart of a method of deploying a boom and maintaining the boom afloat in water, according to some embodiments.

FIG. 1B is a flowchart of a method of deploying a boom and maintaining the boom afloat in water, according to some embodiments.

In some embodiments, a boom sleeve comprising multiple boom units is provided, each unit defining, in a deployed configuration, an upper portion and a lower portion (151). Optionally, the upper portion is positioned above the water surface, and the lower portion below the water surface.

In some embodiments, at deployment, the boom unit is allowed to self-expand as the upper portion is opened in response to spring based actuation, thereby causing the lower portion to expand (153). In some embodiments, a spring and/or other elastic element configured in the upper portion opens up the upper portion (e.g. when released), forming the polygonal chamber defined by the upper portion. As the upper portion is opened, expansion of the bottom portion is triggered.

In some embodiments, in the expanded configuration, the rods define a spatial X shape, where the lower segments of the X shape form the upside V shape, and the upper segments of the X at least partially extend into the upper portion at the lower walls of the chamber.

In some embodiments, during expansion, upper segments of the X shape moved relative to each other (e.g. pushed or pulled) in response to spring activation. In response, the lower sections of the X shape are moved too (for example, moved towards a perpendicular alignment relative to each other, such as to form a 90 degree angle at the crossing).

In some embodiments, the deployed boom is maintained afloat by closed air cells, while being ballasted by one or more of: the structural rods, one or more additional weights (optionally also formed as rods, e.g. shorter rods), and/or by water (155), such as water which enters the hollow and/or water which enters open cells in the boom unit plates. Optionally, water functions as a passive ballast, for example by resisting pull-out of the boom from the body of water.

In some embodiments, the closed air cells are configured as an array of sealed (optionally welded) cells, which are optionally pre-filled (and/or allowed to be filled) with air. Additionally or alternatively, the closed air cells are configured as closed-cell sponge. A potential advantage of a boom unit including sealed air cells may include that no active inflation and/or onsite inflation or filling is required, potentially reducing deployment time and facilitating the deployment process. Another potential advantage of an array of sealed, pre-filled air cells may include reducing a risk of the cells being punctured or otherwise damaged, for example as compared to larger compartments that are inflated on site.

In some embodiments, the closed air cell arrays are configured on plates forming the upper boom unit portion, for example, defining the upper walls of the chamber. In an example, upper walls of the chamber include a layered structure, in which closed cell sponge is layered on top of an array of closed air cells. Optionally, a sheet forming the elongate boom sleeve is mounted onto the sponge on a surface opposite the surface being mounted onto the array.

A potential advantage of plates comprising an array of cells may include improving a resistance of the plate to collapsing or bending. The cells may enhance rigidity, which may be especially important for the upper boom unit portion which does not include the stiffening rods.

FIGS. 2A-E schematically show self-expansion of a boom unit comprising vertically oriented elongate structural elements and optionally an elastic element, according to some embodiments.

Figure 2A:
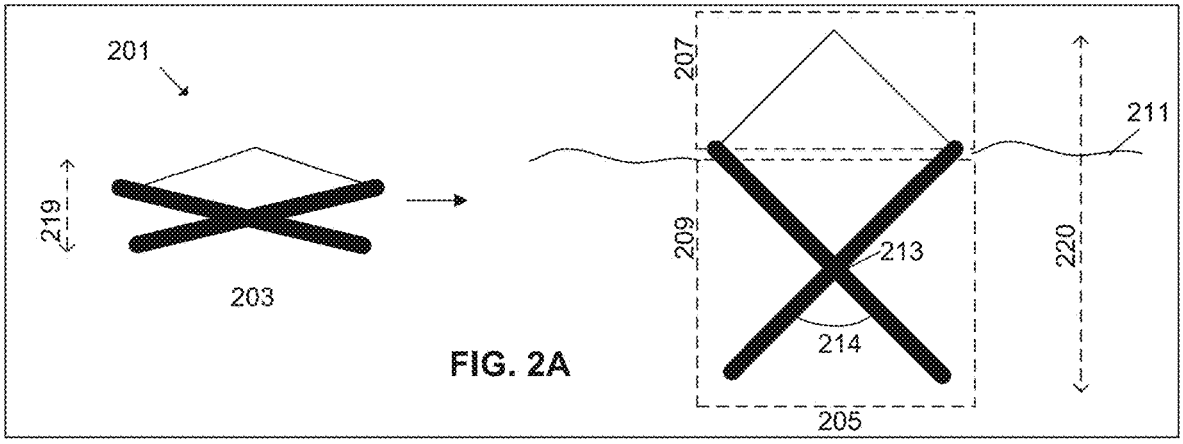
FIGS. 2A, 2B. 2C. 2D and 2E schematically show self-expansion of a boom unit comprising rigid elongate structural elements and optionally an elastic element, according to some embodiments.

FIG. 2A shows a boom unit 201 (at a cross section) expanding from a folded state 203 to an open, expanded state 205. The exemplary boom unit defines an upper portion 207, which when the boom is deployed remains substantially above water level 211, and a lower portion 209, which when the boom is deployed remains substantially below water level.

In some embodiments, lower boom portion 209 and/or upper boom portion are constructed of plates. In some embodiments the plates are made of rigid or semi-rigid material such as plastic. Optionally, the plates are formed with cavities in the plate. In some embodiments a plate is formed by joining two or more materials, for example a semi rigid plastic plate, optionally with cavities as mentioned above, attached to a flat foam or plastic film material which adheres to the plate and seals the cavities like a lid.

In some embodiments, the lower boom portion 209 includes plates arranged to form an X-shape. In some embodiments, the fully expanded X-shape defines a crossing 213 where a downward facing angle 214 between the crossing plates is between, for example, 70-100 degrees, e.g. 85 degrees, 90 degrees, 95 degrees or intermediate, larger or smaller angle.

In some embodiments, a thickness (height) 219 of the boom unit in a folded state is for example between 1 cm-10 cm, e.g. 2.5 cm, 5 cm, 7 cm or intermediate, higher or lower thickness. In some embodiments, a height 220 of the boom unit in the expanded state is for example between 28-80 cm, such as 32 cm, 38 cm, 60 cm or intermediate, higher or lower thickness.

Figure 2B:
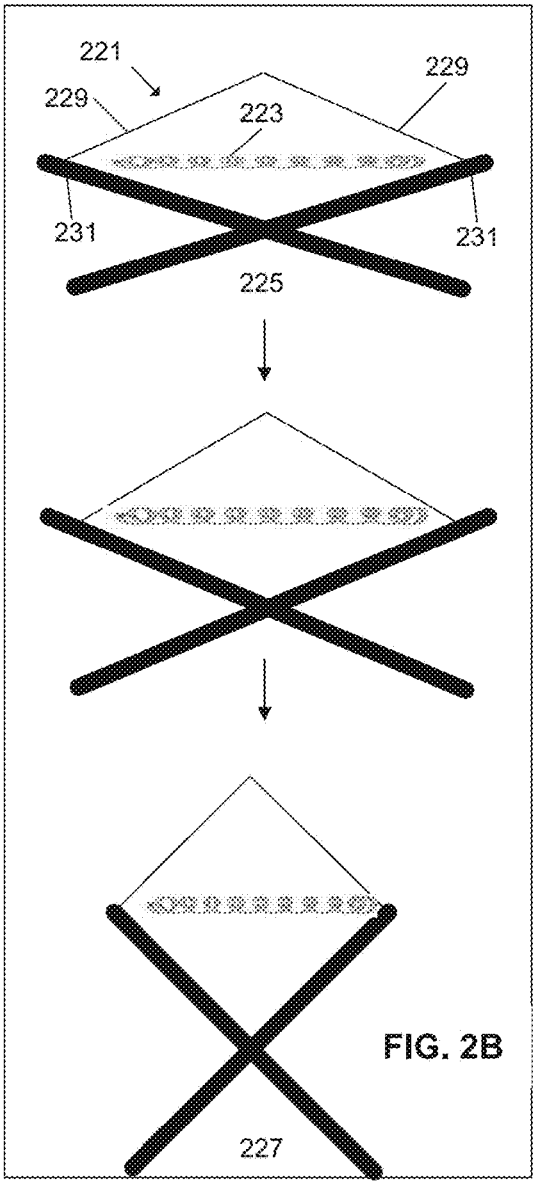

FIG. 2B shows a boom unit 221 comprising a horizontally extending elastic element 223. As shown, the boom unit self-expands from a folded state 225 to an open, expanded state 227. In some embodiments, the elastic element 223 extends horizontally between two opposing plates 229 of the upper boom portion. Alternatively, the elastic element extends horizontally between horizontally-opposing coupling points 231, the coupling point defining a joint between an upper portion plate and a lower portion plate.

Figure 2C:
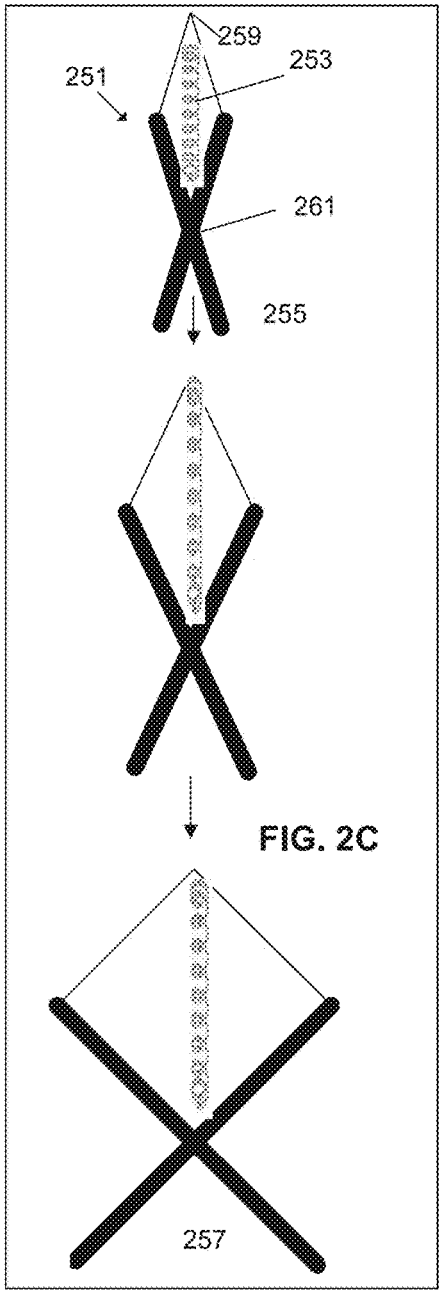

FIG. 2C shows a boom unit 251 comprising a vertically extending elastic element 253. As shown, the boom unit self—expands from a folded state 255 to an open, expanded state 257. In some embodiments, the elastic element 253 extends vertically between a coupling point 259 in which plates of the upper boom portion join each other, to a crossing 261 of the X-shaped plates of the lower boom portion.

In some embodiments, the elastic element (such as 223 of FIG. 2B and 253 of FIG. 2C) comprises a spring, e.g. a coil spring. In some embodiments, in the folded state of the boom, the spring is extended (or, in some embodiments, compressed), and at deployment springs-back into a relaxed or almost relaxed configuration, thereby moving boom portions towards or away from each other, to generate expansion of the boom unit.

In some embodiments, tension produced by the spring is sufficient to approximate opposing boom portions and/or coupling points to each other, thereby re-shaping at least a portion of the boom unit. In some embodiments, by reshaping a portion of the boom unit, another boom portion is thereby reshaped. For example, in FIG. 2B, spring actuation approximates coupling points 231 towards each other, thereby pulling upper segments of the X-shape towards each other, which in turn cause the lower segments of the X-shape to come closer to each other, thereby reducing an angle of the upside down V shape (at the crossing). In the example of FIG. 2C, upon release from a folded state, the vertical spring 253 approximates coupling point 259 to crossing 261, thereby spreading apart the upper segments of the X shape which in turn spread apart the lower segments of the X shape, thereby increasing the angle of the upside down V shape (at the crossing).

In some embodiments, the opposing ends of the spring are attached to the boom plates and/or to coupling points by fasteners, such as clips, nylon thread, hooks, screws, and/or other attachment means. In some embodiments, attachment of the spring to the boom unit is strong enough so as to resist a pulling force generated by the spring, and to prevent the spring end from detaching.

Figure 2D:
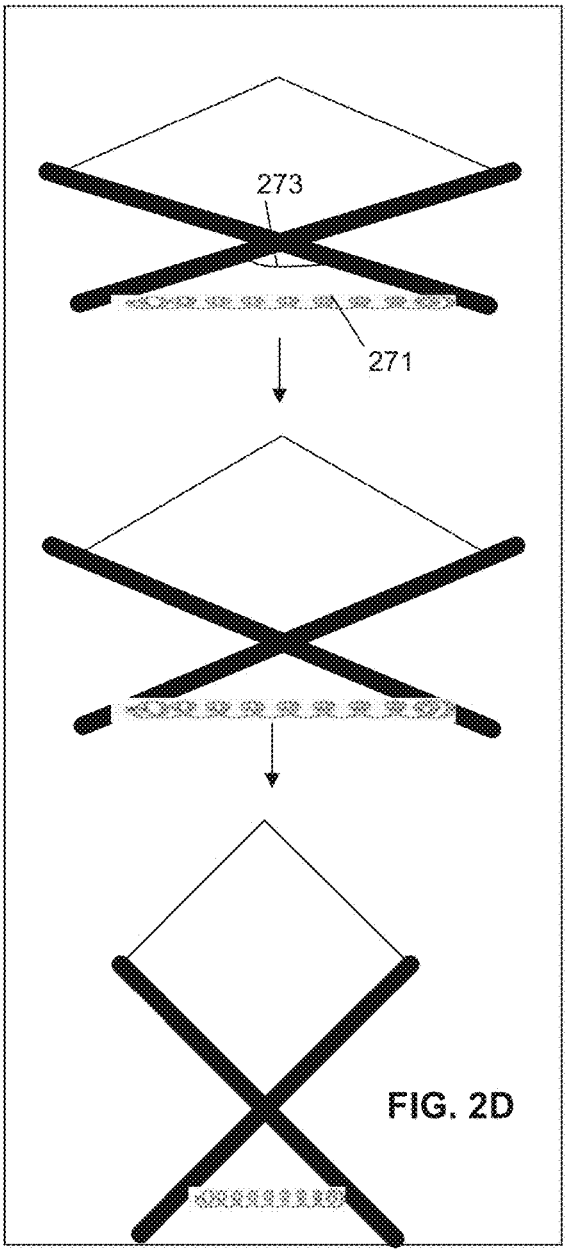

In the example of FIG. 2D, an elastic element 271 extends horizontally between the lower segments of the X-shape. Optionally, the ends of the elastic element are attached to the plates of the lower segments and/or to the lower segments of the rods. Upon unfolding of the boom unit, the elastic element pulls on the segments to move them closer, thereby reducing an angle 273 of the upside down V at the crossing.

Figure 2E:
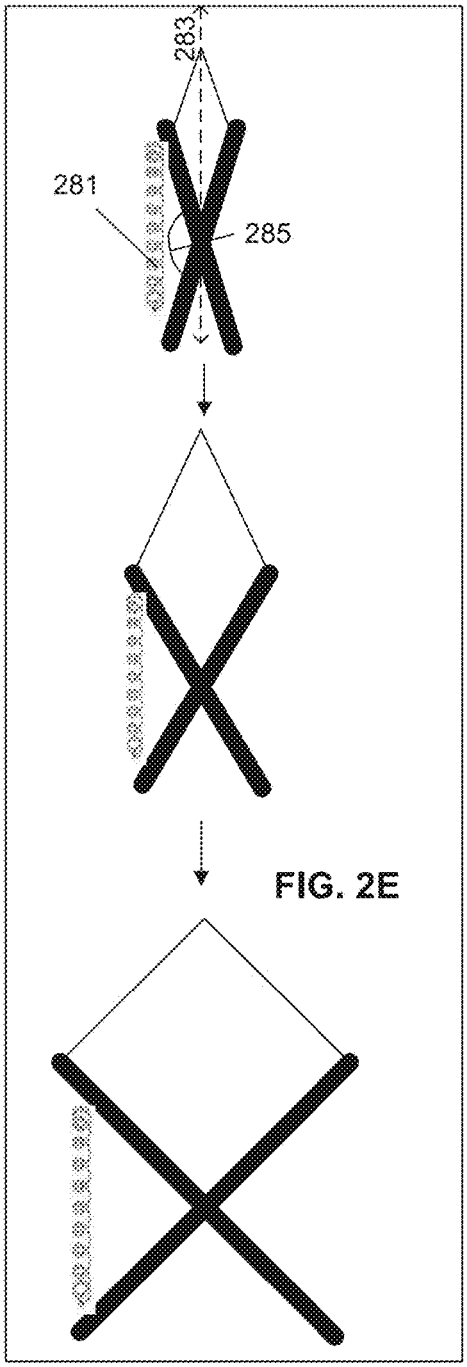

In the example of FIG. 2E, an elastic element 281 extends between an upper segment of the X shape and a lower segment of the X-shape which are located on the same side of a long axis 283 of the boom unit. Optionally, the ends of the elastic element are attached to the plates of the segments and/or to the segments of the rods. Upon unfolding of the boom unit, the elastic element pulls the connected segments to move them closer, thereby reducing a sideways facing angle 285 at the crossing.

Figure 3A:
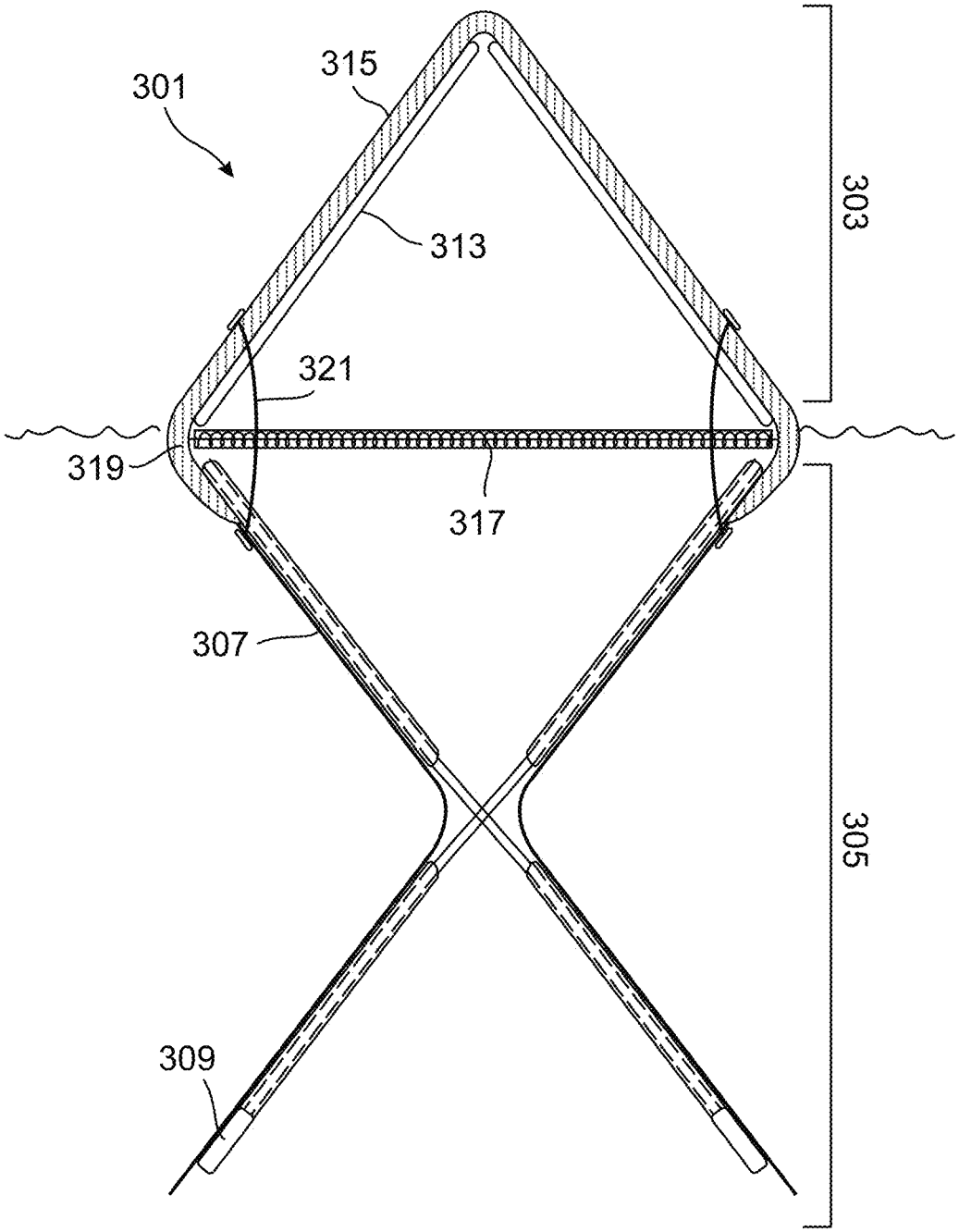
FIGS. 3A-B are a cross section view of a boom unit comprising elongate rods, weights, and a horizontally extending elastic element, shown in expanded state (FIG. 3A) and a folded state (FIG. 3B), according to some embodiments.

FIG. 3A is a cross section view of an expanded boom unit comprising elongate rods, weights, and a horizontally extending elastic element, according to some embodiments.

In some embodiments, the boom unit 301 defines an upper portion 303, and a lower portion 305.

In some embodiments, plates of the lower portion 305 are formed with elongate cavities formed as cells. In some embodiments, the cells are arrayed adjacent each other. Optionally, the cells are welded to the plate. Optionally, the cells are vacuum formed. In some embodiments, vacuum formed cells are welded to the boom sheet (e.g. a polyethylene sheet), and the closed cells that are formed function as floats.

In some embodiments, the cells are left open or partially open, optionally allowing water to enter and fill the cell. In some embodiments, cells filled (or partially filled) with water function to ballast the boom unit.

In some embodiments, rigid elongate elements such as rods 307 are positioned (e.g threaded) within at least some of the cells of the lower portion plates. Optionally, only a single rod 307 is positioned within a cell. In some embodiments, rods are positioned within directly opposing cells, arranged on a similar plane, for example as further shown below in FIGS. 6A-C. Alternatively, rods are arranged in a staggered configuration, for example as schematically shown below in FIGS. 4A-C and FIG. 5.

In some embodiments, rods configured in opposing plates of the lower boom unit portion define an X shape in the expanded state of the boom unit. In some embodiments, the rods are vertically oriented, for example, being substantially perpendicular to the water surface or perpendicular to a plane substantially parallel to the water surface (since the rods are below water surface level).

In some embodiments, the rods are formed of or comprise rigid material, such metal, fiberglass, plastics, and/or rigid composites. In some embodiments, the rods do not or only lightly bend in response to an applied force.

In some embodiments, the rods are rigid enough to resist bending, for example so as to maintain the spatial X shape. In some embodiments, the rods are configured for at least some degree of deformation, for example so that the rod flexes in response to an applied force as opposed to breaking.

In some embodiments, in the expanded state, the rods stabilize and rigidify the boom unit. A potential advantage of the vertically oriented spatial arrangement of rods may include enhancing the boom unit's resistance to external applied forces (such as forces due to waves, water current and/or winds), potentially preventing tip-over.

In some embodiments, one or more weights 309 are disposed within one or more cells of the lower portion plates. Optionally, the weights are shaped as elongate rods threaded into the cells. Alternatively, in some embodiments, the lower plates do not comprise cells and/or the rods are not positioned within cells, and are attached to the plates by other means, such as by fasteners and/or a mounting.

In some embodiments, a total weight added to one meter of the boom sleeve (e.g. in the form of metal weights) is no more than 100, 200, 500 grams/meter or intermediate, higher or lower weight.

In an example, for a boom sleeve of 15 meters in length which includes 32 boom units, the structural rods (when formed of metal) weigh a total of 3.6 Kg, and the shorter rod weights (when formed of metal) weigh a total of 2.7 Kg. In some embodiments, a size of the weight is selected in accordance with the position of the weight relative to the boom unit (for example, relative to a vertical axis of the boom unit.) Optionally, by positioning the weight at a lower or lowest point along the vertical axis of the boom unit, a higher ballasting effect is achieved.

In some embodiments, a cell may include both an elongate structural rod and a weight, e.g. a rod shaped weight. Optionally, the rod shaped weight is positioned as a linear extension of the structural rod. Alternatively, weights are positioned in cells different than those containing the rods.

Additionally or alternatively, the elongate structural rod itself functions as a weight, for example when formed of metal and/or other material which is sufficiently heavy to function as ballast.

In some embodiments, the structural rod is longer than a ballast formed as a rod. Optionally, a length ratio between a structural rod long axis and a ballast rod long axis is, for example, between 4:1, 10:1, 6:1 or intermediate, higher or smaller ratio.

In some embodiments, plates of the upper portion 303 include closed air filled cells. Optionally, the cells are welded to the plate. Optionally, the cells are vacuum formed. In some embodiments, an array 313 of sealed cells containing air is mounted onto a layer of closed-cell sponge 315. A potential advantage of sealed air cells and/or closed cell sponge which does not absorb fluid may include that water and/or spill material (e.g. oil) do not enter at least the upper plates of the boom unit, so that floatation is maintained.

In some embodiments, the cell array and/or the sponge layer are mounted onto the material of the sheet forming the elongate boom sleeve.

In some embodiments, air encapsulated within the array of cells and/or within the closed cell sponge is at a volume sufficient to maintain the boom afloat. In some embodiments, the floating force provided by the closed air cells is balanced with the gravity force produced by the total weight of the boom unit. Optionally, in an equilibrium state of a deployed boom unit, the water level reaches about 0-10 mm above the coupling points of the upper boom portion to the lower boom portion.

In some embodiments, boom unit 301 comprises an elastic element, such as a spring 317. In this example, the spring extends horizontally between opposing coupling points 319, each defining a joint between the upper portion plate and the lower portion plate.

In some embodiments, boom unit 301 comprises one or more fastening elements configured to at least partially limit movement of boom portions with respect to each other. In this example, an elongate fastener 321 (e.g. a nylon thread) extends between an upper portion plate and a lower portion plate, potentially limiting movement (e.g. vertical movement away from each other) of the two plates. Additional or other fasteners may be positioned to limit vertical and/or horizontal movement of boom portions relative to each other. In some embodiments, the fastening element is configured and positioned to resist a force applied to the boom unit portions by the elastic element (e.g. the spring). Other examples of fastening elements include clips, hooks, ties, screws.

Figure 3B:
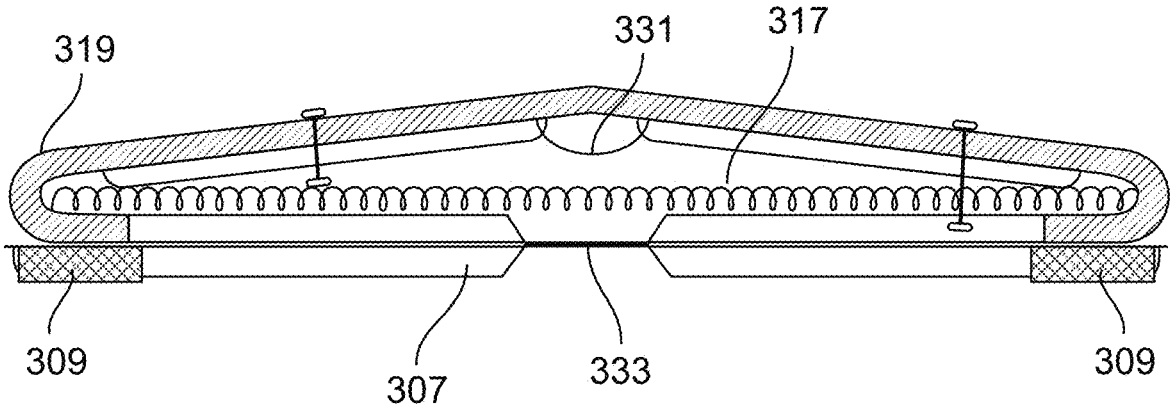

FIG. 3B schematically illustrates, at a cross section, the folded boom unit of FIG. 3A. The lower and upper boom unit portions are folded towards each other about the long axis of the horizontally extending spring 317. Spring 317 is shown in a stretched, extended configuration.

In some embodiments, in the packed boom sleeve, when the units are in a folded state, the units are layered one on top of each other (such as in an accordion configuration), so that the layering of the units prevents the spring from bouncing back to its relaxed configuration. Additionally or alternatively, the folded boom sleeve is packaged in a closed container (e.g. a box), where the boom units are held compressed and their expansion is prevented or limited. In some embodiments, the boom is kept folded using straps, bends, elastic sheets, Velcro and/or other binding elements. In some embodiments, water soluble sheets such as plastic PVA sheets maintain the boom folded, and dissolve when in contact with water, such as when the boom is deployed.

In some embodiments, a full boom sleeve (for example having a length of between 10m-100m) is lightweight enough for carrying by a single user. For example, the weight of a boom sleeve packed in a box or other package is less than 25 Kg, less than 30 Kg, less than 20 Kg or intermediate, higher or lower weight.

As further shown in FIG. 3B, in some embodiments, in the folded state, the elongate rods 307 (and weights 309 which optionally extend linearly to the rods) are collapsed. Plates of the upper portion (including the closed cell array and sponge layer) are also pulled downwards towards the extended spring.

In some embodiments, upon release of the boom sleeve (e.g. following removal of the boom sleeve from its container), the spring bounces and reduces in length. The ends of the spring pull on coupling points 319 and approximate them towards each other. Plates of the upper portion are moved in a forceps-like movement towards each other, and an angle 331 between them is reduced in size (e.g. from a 180, 160, 140 degree angle or intermediate, higher or smaller angle in the folded state to a 100 degree, 90 degree, 80 degree angle or intermediate, higher or smaller angle in the expanded state). Plates of the lower portion, which define the upper and lower segments of the X shape, pivot about the crossing 333 of the X, reducing the angle at the crossing.

In some embodiments, a force (e.g. pulling force) applied by the spring for expanding a boom unit is less than 10N, less than 5N, less than 15N, less than 1N or intermediate, higher or lower force.

Figure 4A:
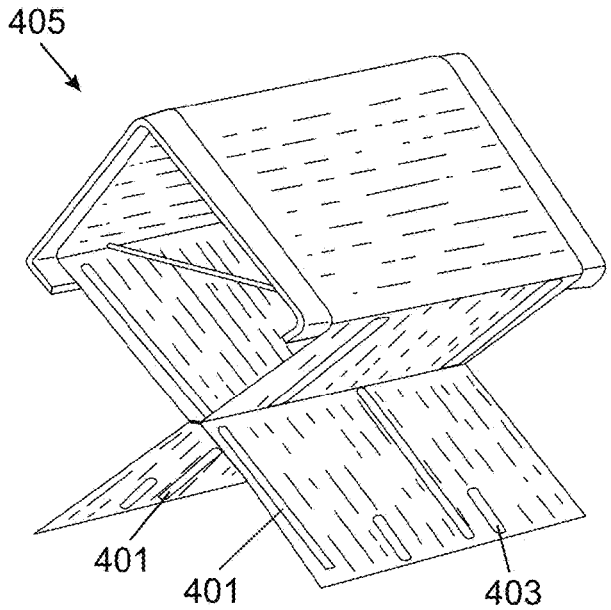
FIGS. 4A-C schematically illustrate an expanded boom unit comprising staggered elongate rods, weights, and a horizontally extending elastic element (FIG. 4A), an expanded boom sleeve segment (FIG. 4B), and a bottom view (FIG. 4C) of the boom sleeve segment, according to some embodiments.
Figure 4B:
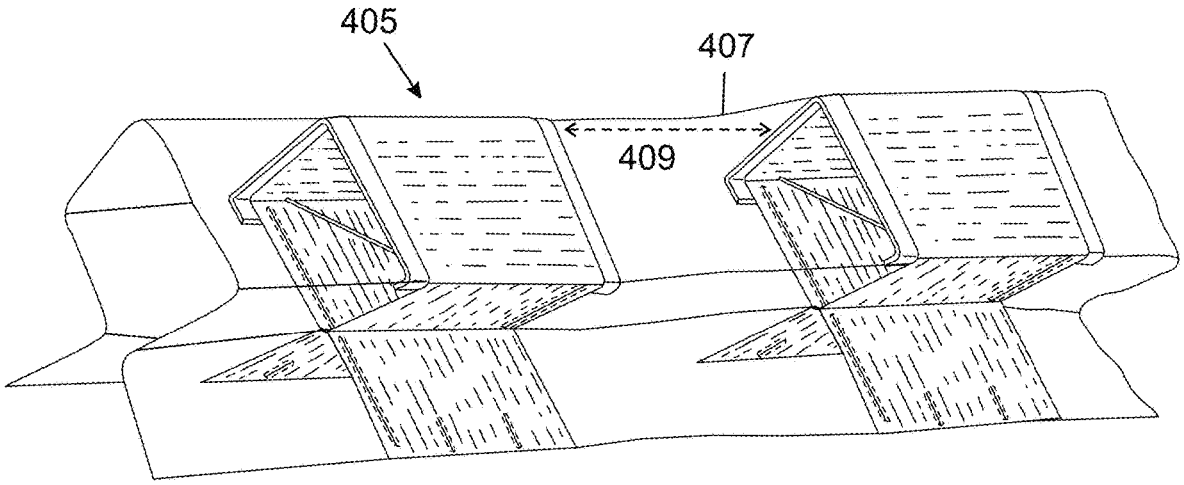
Figure 4C:
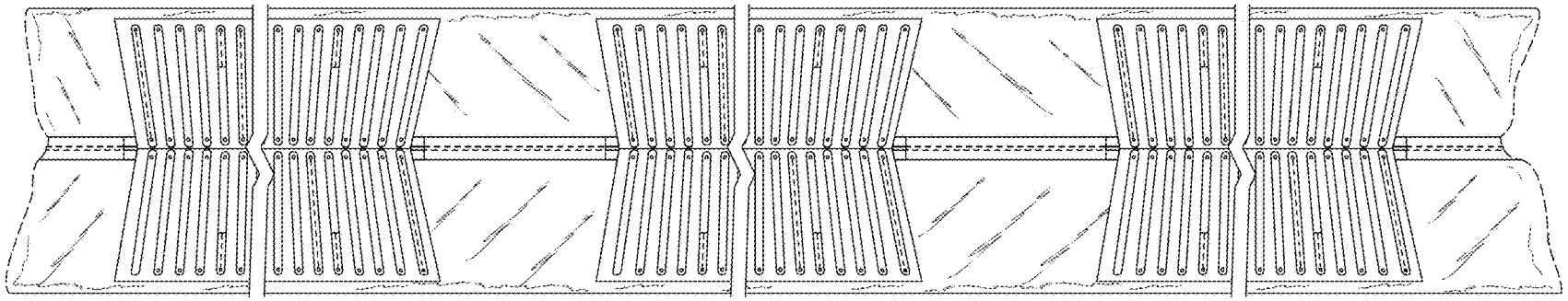

FIGS. 4A-C schematically illustrate an expanded boom unit comprising staggered elongate rods, weights, and a horizontally extending elastic element (FIG. 4A), an expanded boom sleeve segment (FIG. 4B), and a bottom view (FIG. 4C) of a boom sleeve segment, according to some embodiments.

In some embodiments, as shown in this example, the elongate structural rods 401 are arranged in a staggered configuration, in which two rods which form the spatial X shape together are spaced apart from each other, for example by one or more cells which do not contain rods and/or by material forming the plate. In some embodiments, rods (or rod pairs) are spaced at equal distances from each other. A potential advantage of constant distances between rods may include a more uniform distribution of the forces acting on the rods. Alternatively, rods are placed at different distance intervals from each other.

In some embodiments, as shown in this example, the boom unit includes short rod weights 403, optionally disposed within cells of the lower segments of the X-shape. Optionally, the rod weights are placed at constant intervals from each other and/or from the structural rods.

In some embodiments, boom units 405 are dispersed along the boom sleeve 407 (see FIG. 4B) at an axial distance 409 of, for example, 0.5 cm-20 cm, 5-10 cm, 1-5 cm or intermediate longer or shorter distance from each other.

Figure 5:
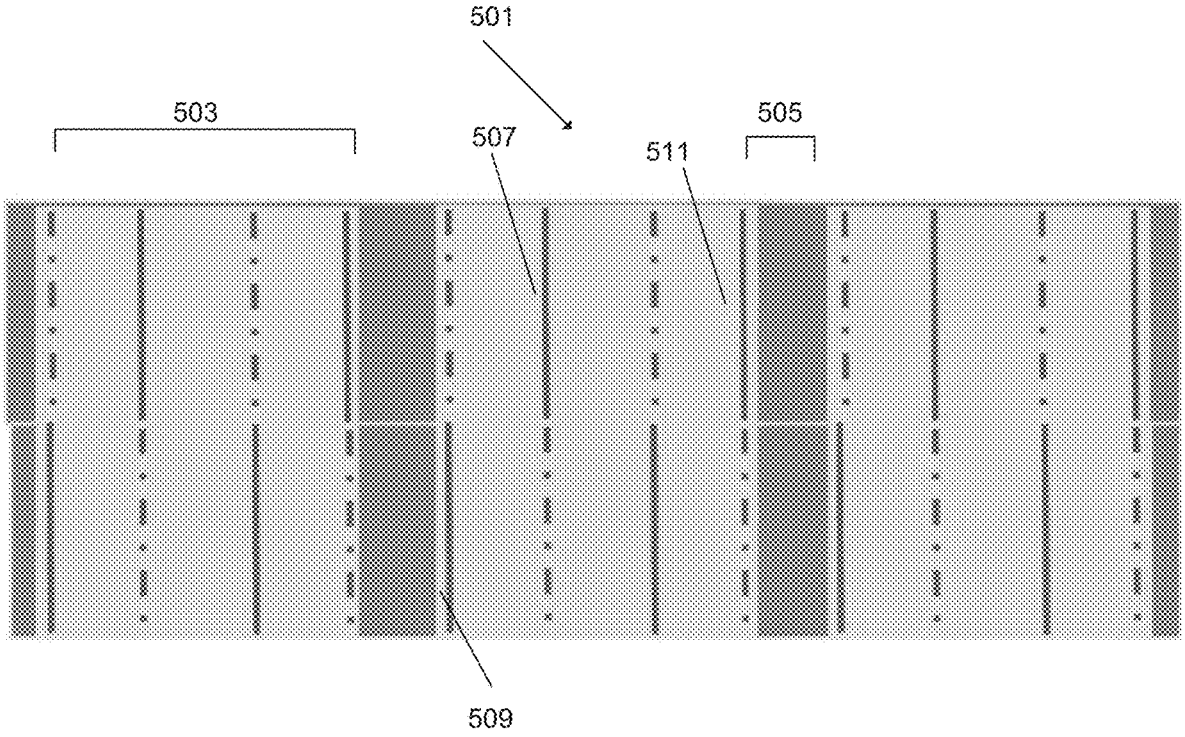
FIG. 5 schematically illustrates a staggered arrangement of elongate rods of a boom unit, according to some embodiments.

FIG. 5 schematically illustrates a staggered arrangement of elongate rods of a boom unit, according to some embodiments.

FIG. 5 schematically shows a bottom view of a boom sleeve segment 501, including, in this example, 3 boom units 503 configured axially along the boom sleeve, with spaces 505 (e.g. of sleeve material) in between them.

In some embodiments, as shown, the structural rods are arranged in a staggered configuration, in which a pair of rods 507 and 509 which together define the X shape of the boom unit are configured not on the same plane, but on parallel planes. In this manner, rods configured on the same side of a plate (e.g. in the same array of cells), such as 507 and 511, are spaced apart from each other. A potential advantage of the staggered arrangement which sets spaces between adjacent rods may include reducing friction between the rods (e.g. between rods 507 and 511). Another potential advantage of the staggered configuration may include improving the structural support provided by the rods as the rods are distributed with spaces in between and potentially support a larger surface area of the plate.

Figure 6A:
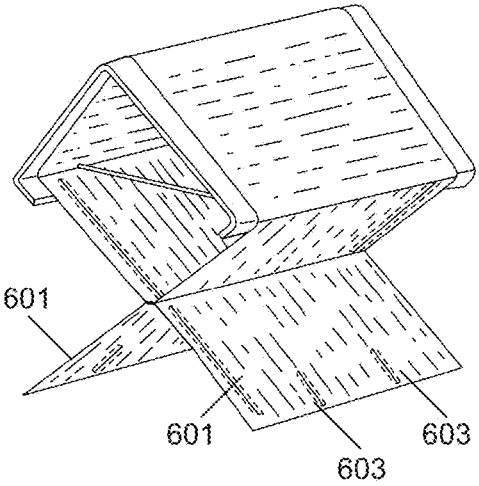
FIGS. 6A-C schematically illustrate an expanded boom unit comprising elongate rods arranged on a similar plane, weights, and a horizontally extending elastic element (FIG. 6A), an expanded boom sleeve segment (FIG. 6B) comprising boom units as in FIG. 6A, and a bottom view (FIG. 6C) of a boom sleeve segment, according to some embodiments.
Figure 6B:
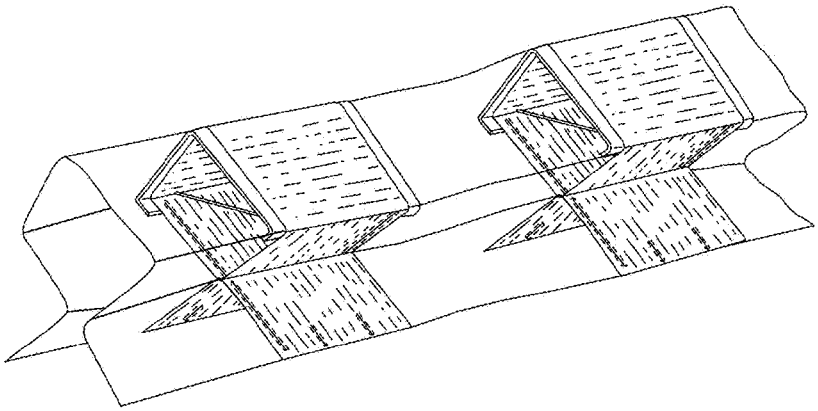
Figure 6C:
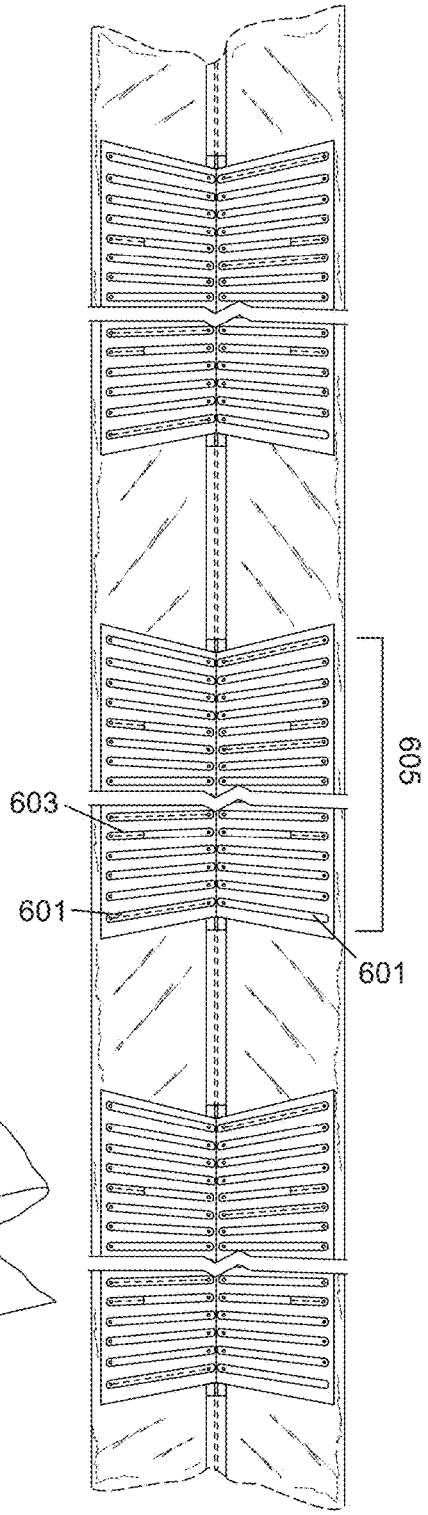

FIGS. 6A-C schematically illustrate an expanded boom unit comprising elongate rods arranged on a similar plane, weights, and a horizontally extending elastic element (FIG. 6A), an expanded boom sleeve segment (FIG. 6B) comprising boom units as in FIG. 6A, and a bottom view (FIG. 6C) of a boom sleeve segment, according to some embodiments.

The boom illustrated in FIGS. 6A-C includes an alternative arrangement of structural rods, according to some embodiments, in which a pair of rods 601 which together define the X shape are arranged on the same plane. A potential advantage of rods arranged on a same plane may include higher resistance to twisting forces acting on the boom unit.

In some embodiments, rod pairs are positioned at constant intervals from each other. In the example shown herein (see the bottom view of FIG. 6C), a first pair of rods is located at one end of the boom unit 605 and a second pair of rods is positioned at a second opposite end of the boom unit 605 (such as along the boom sleeve axis).

In some embodiments, weights 603 (e.g. rod shaped weights) for ballasting the unit are positioned directly opposing each other. Optionally, weight pairs are spaced apart from structural rod pairs. Alternatively, a weight is positioned adjacent (e.g. linearly to) the structural rod.

In the example shown herein, each boom unit 605 includes 4 weights. In some embodiments, a boom unit comprises between 2-20 weights, such as 2 weights, 6 weights, 16 weights or intermediate, higher or smaller number.

In some embodiments, in a pair of rods arranged on the same plane, the rods may be shaped to connect to each other at the crossing, for example by one of the rods including a slot or recess and the other slot including a protrusion suitable for fitting inside the recess. Optionally, the connection between the rods is configured to provide for the rods to pivot relative to each other.

Figure 7A:
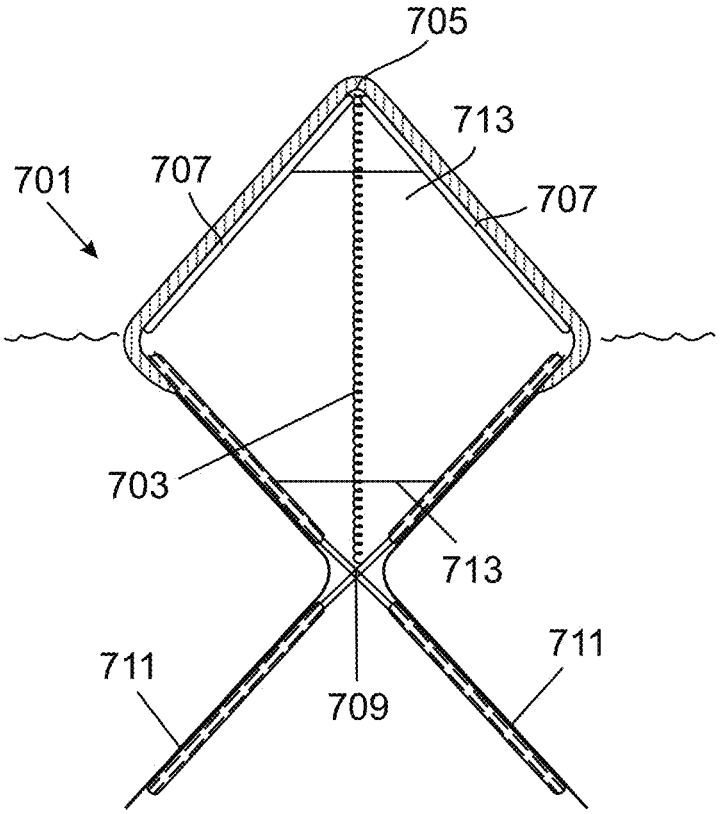
FIGS. 7A-B schematically illustrate, at a cross section, a boom unit comprising a vertically extending elastic element, shown at an expanded state (FIG. 7A) and a folded state (FIG. 7B), according to some embodiments.
Figure 7B:
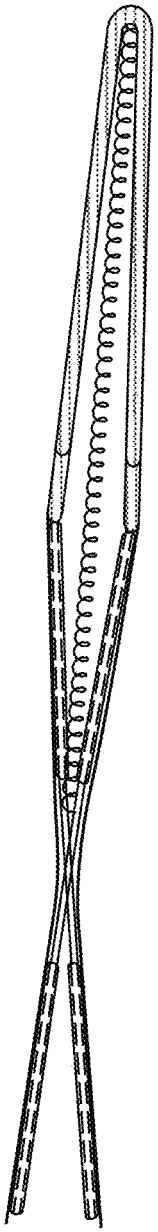

FIGS. 7A-B schematically illustrate, at a cross section, a boom unit comprising a vertically extending elastic element, shown at an expanded state (FIG. 7A) and a folded state (FIG. 7B), according to some embodiments.

In some embodiments, a boom unit 701 comprises a vertically extending spring 703. Optionally, the spring extends from a coupling point 705 of the upper portion plates 707 to a crossing 709 of the X-shape defined by the lower portion plates 711.

In some embodiments, in the folded state (as shown in FIG. 7B), spring 703 is extended. Optionally, the boom unit is folded about the long axis of the extended spring, for example such that upper portion plates 707 and the upper segments of the X-shape defined by the lower portion plates 711 are maintained in close proximity to the spring, along the length of the spring.

In some embodiments, the boom unit comprises one or more fasteners 713 (see FIG. 7A). In this example, the fasteners are positioned to reduce or limit movement of plates positioned opposite each other relative to the spring, for example, limiting movement of the plates relative to each other along a horizontal axis.

Figure 8A:
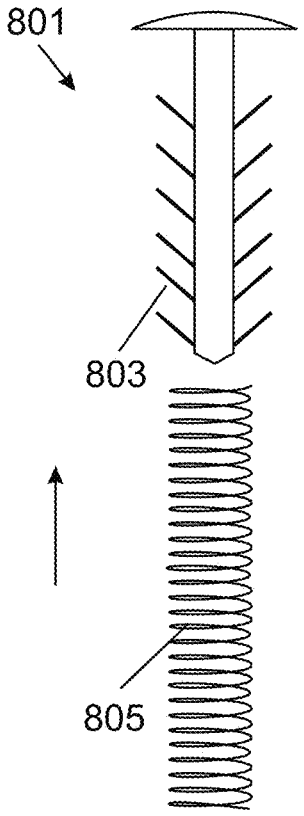
FIGS. 8A, 8B and 8C show an exemplary attachment for coupling an elastic element to a boom unit, according to some embodiments.
Figure 8B:
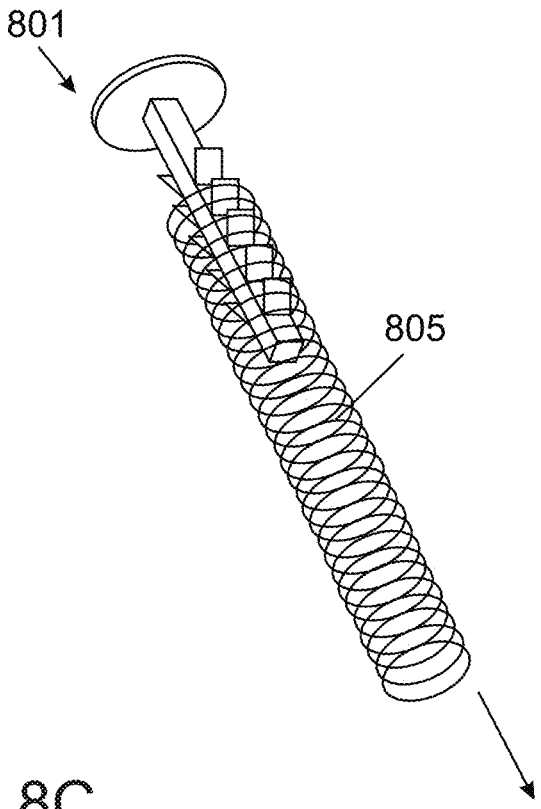
Figure 8C:
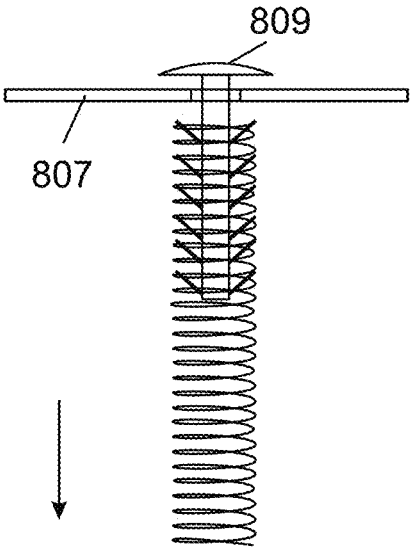

FIGS. 8A-C show an exemplary attachment for coupling an elastic element to a boom unit, according to some embodiments.

In some embodiments, the elastic element is attached to the boom unit plates and/or to the boom unit coupling points (e.g. joints between plates) using one or more fasteners. In this example, a tree clip fastener 801 is shown.

In some embodiments, as shown in FIG. 8A, the tree clip fastener includes a plurality of fins 803 extending radially outwardly, at an angle to the long axis of the clip. In use, as shown for example in FIG. 8B, an elastic element in the form of a coil spring 805 is placed (such as by dressing the spring or threading it) onto the tree clip. The deflected fins 803 prevent the inserted spring from being pulled off the clip. In FIG. 8C, the tree clip fastener couples the spring 805 to a boom unit plate 807. In some embodiments, a head of the clip 809 is placed against the surface of the plate 807, while the finned body of the clip maintains hold of the spring that is dressed on it.

It is noted that other attachment means such as screws, bolts, pins, clips, ties, may be used for coupling the spring to the boom unit. The attachment needs to be strong enough to maintain the spring coupled to the boom unit even when the spring is pulled on (e.g. in the folded state) and extended.

Figure 9A:
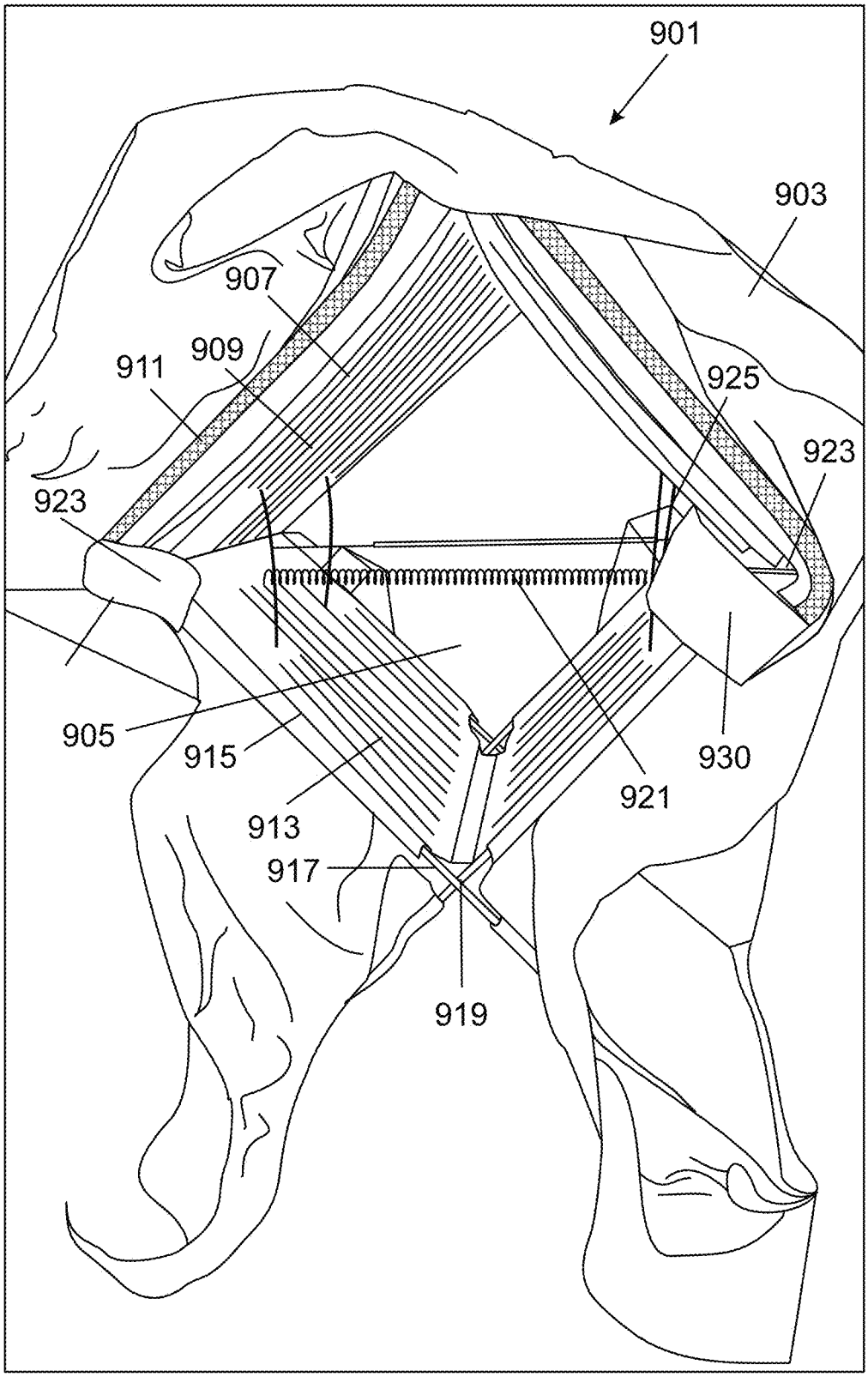
FIGS. 9A-B are images of a boom unit comprising elongate rods and a horizontally extending elastic element, shown in an expanded state (FIG. 9A) and a folded state (FIG. 9B), according to some embodiments.
Figure 9B:
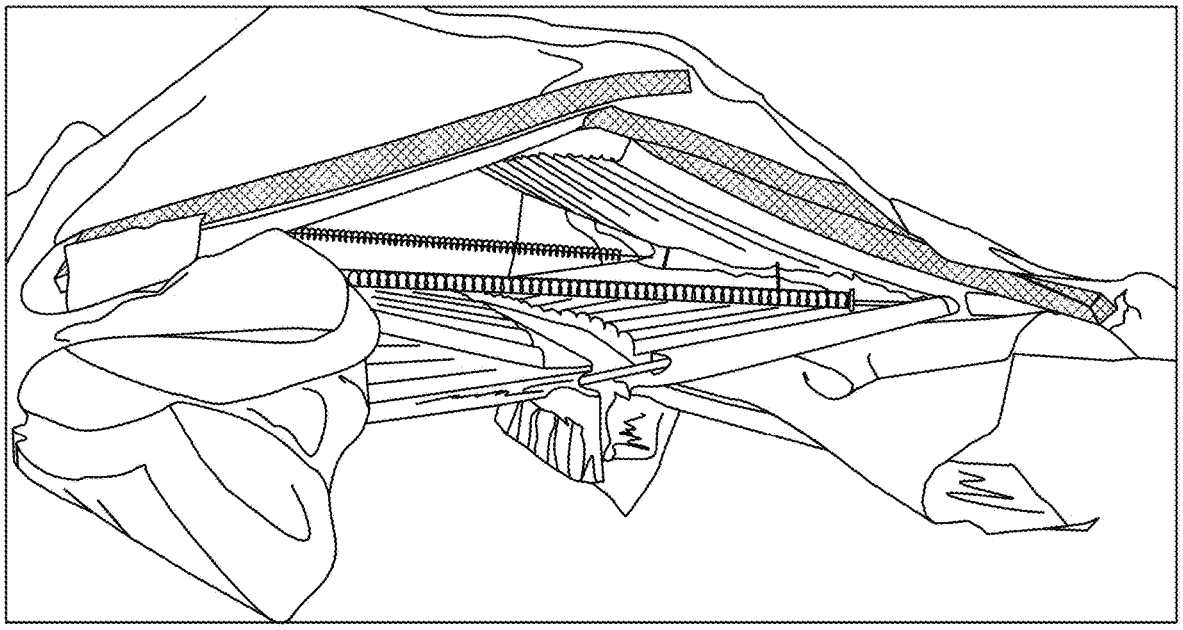

FIGS. 9A-B are images of a boom unit comprising elongate rods and a horizontally extending elastic element, shown in an expanded state (FIG. 9A) and a folded state (FIG. 9B), according to some embodiments.

In some embodiments, a boom unit 901 comprises a plurality of plates which form the walls of the unit, attached to an external sleeve 903 (where in a full boom, the sleeve extends along the axial length of the boom).

In some embodiments, the expanded boom unit defines a hollow 905, optionally polygonal, e.g. rhombus shaped. In some embodiments, the hollow is not polygonal, for example, rounded (e.g. a circular hollow).

In some embodiments, plates 907 of the upper boom unit portion are formed with an array of closed cells 909 in which air is contained and sealed. In some embodiments, a layer of closed cell sponge 911 is mounted on an external side of the cell array. Optionally, the external boom sleeve 903 is attached onto the external face of the sponge layer.

In some embodiments, plates 913 of the lower boom unit portion are formed with an array of open cells 915. Optionally, in use, water is allowed to flow in and/or out of the cells. In some embodiments, the open cells are designed to drain slowly, for example to increase resistance to forces acting to pull the boom out of the water, such as a blast of wind or strong streams. In some embodiments, slow draining is achieved by the cells having openings which are small enough to slow a rate in which water flows out of the cells, for example when forces are acting on the boom to pull it out of the water. In some embodiments, during boom deployment, the openings allow water to flow into the cells. In some embodiments, the small openings act as a valve which allows water to flow into the cells at a fast rate and flow out of the cells at a much slower rate.

In some embodiments, the lower boom unit portion includes structural elongate elements such as rods 917. In some embodiments, a rod is inserted, at least in part, into cells of the array. In some embodiments, a rod extends diagonally from a cell on a plate which defines a lower segment of the X-shape, to a cell on a plate which defines an upper segment of the X-shape. In some embodiments, at least a portion of the rod remains exposed, for example at a crossing 919 with a paired rod (which together define the X-shape).

In some embodiments, the boom unit comprises an elastic element, e.g. a coil spring 921. In the shown boom, the spring extends horizontally between symmetrically opposing coupling points 923, where upper portion plate joins a lower portion plate. In some embodiments, spring 921 actuates, at least in part, self-expansion of the boom unit from the folded state (of FIG. 9B) to the expanded state (FIG. 9A), for example by returning fully or partially from the spring extended (tensioned) length to the spring rest state (natural) length.

In some embodiments, the boom unit comprises one or more fasteners for limiting movement of boom unit portions relative to each other. For example, nylon threads 925 are used for limiting movement of an upper portion plate relative to a lower portion plate. Optionally, the nylon thread prevents the plates from moving away from each other along the vertical axis.

Figure 11A:
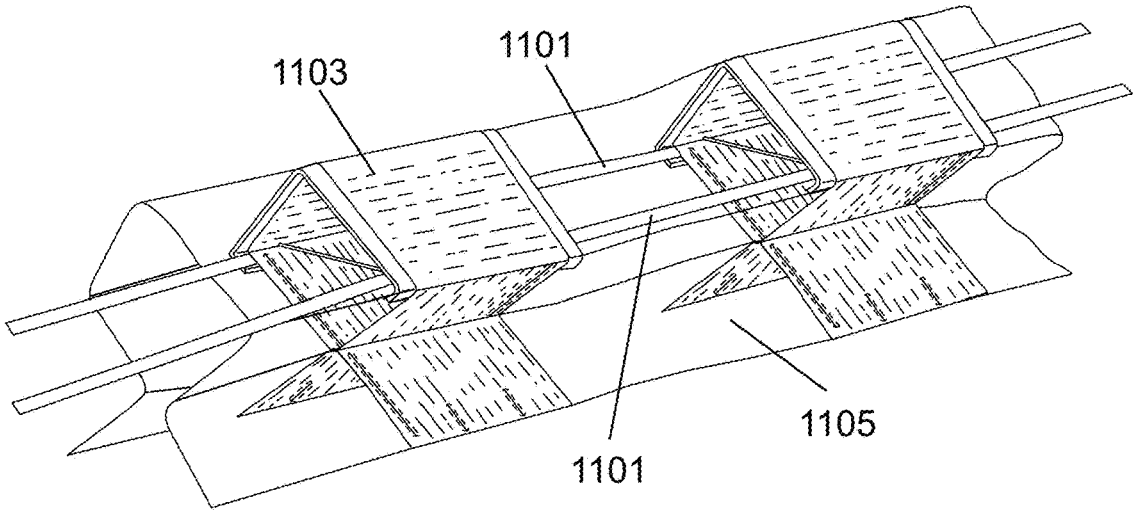
FIGS. 11A-B show axially extending supporters of a boom sleeve, according to some embodiments.
Figure 11B:
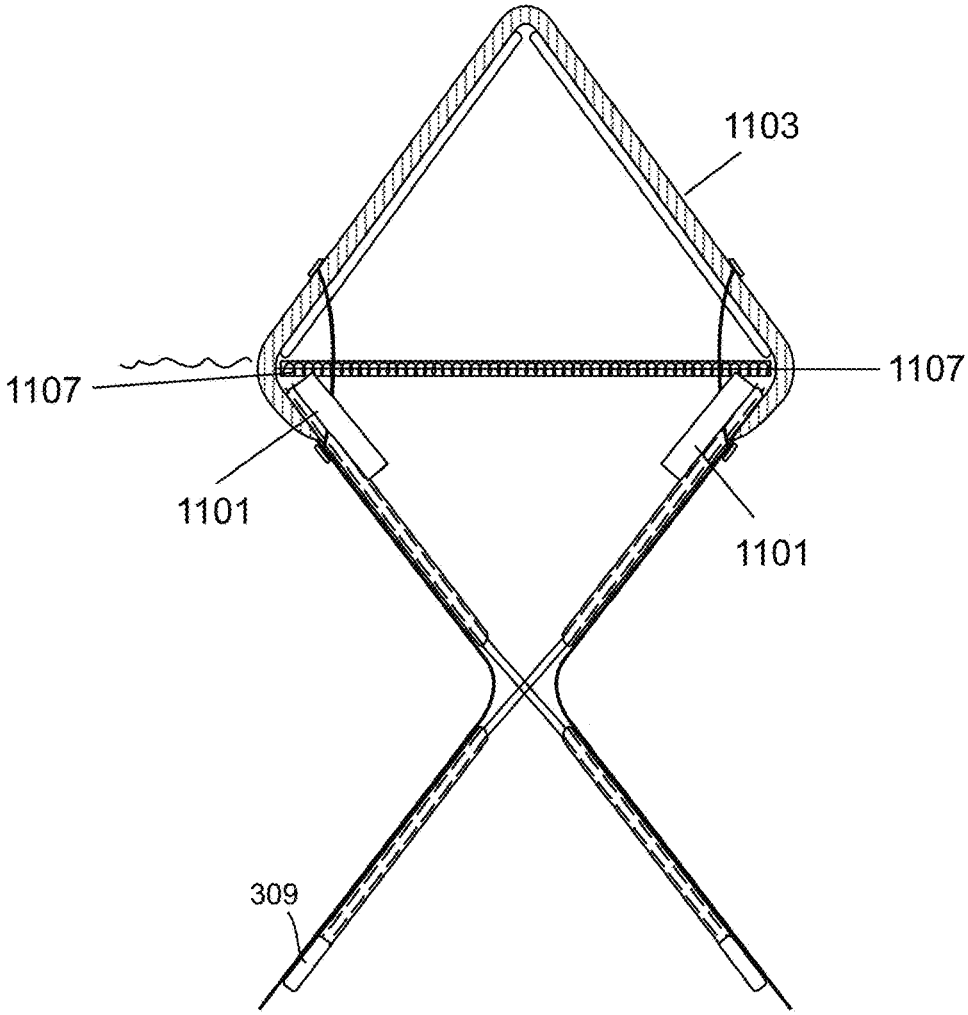

In some embodiments, the boom comprises axially extending supporters which extend along the boom sleeve, optionally along the full length of the boom sleeve (see also FIGS. 11A-B). In some embodiments, the axially extending supporters are positioned and configured to strengthen a chained attachment between sequential boom units. In some embodiments, the axially extending supporters are positioned and configured to increase durability and tensile resistance to tear of the boom sheet, In some embodiments, the supporters increase resistance to local tear, which may occur, for example, when a sharp object or the like acts on a small area of the sheet along the length of the boom sleeve, and may penetrate a hole or cut the sheet.

In some embodiments, the axially extending supporters are formed as straps 930, e.g. nylon and/or PET straps. Optionally, the straps are attached to the boom unit at opposing coupling points 923. The straps may be stitched, glued and/or otherwise attached to the sheet, optionally to the sheet's inner surface.

Figure 10A:
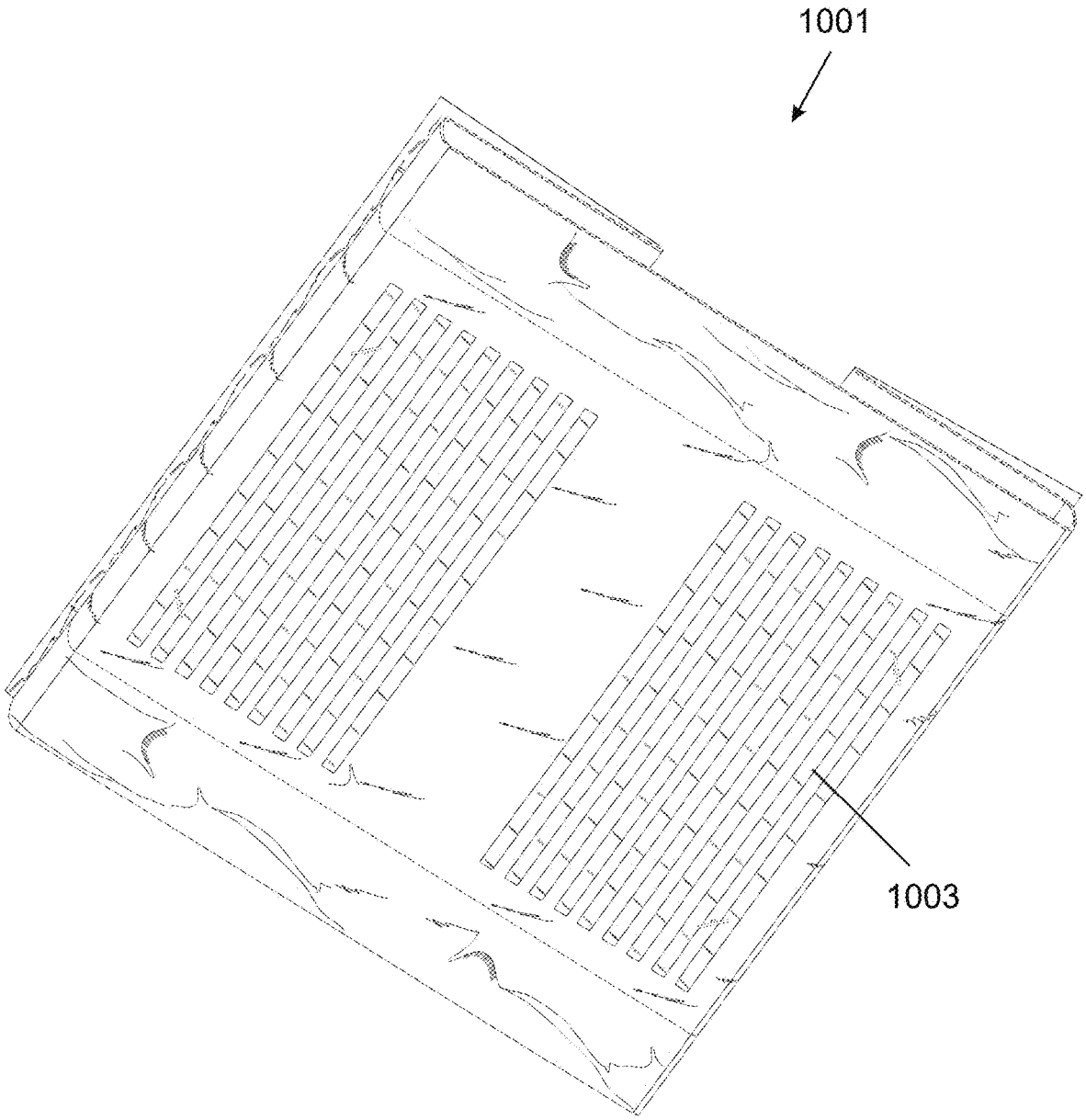
FIGS. 10A-C are a bottom view of a boom unit including a horizontally extending elastic element, in a folded state (FIG. 10A), and an expanded state (FIG. 10B); and an expanded boom sleeve (FIG. 10C) comprising units as shown in FIGS. 10A-B.
Figure 10B:
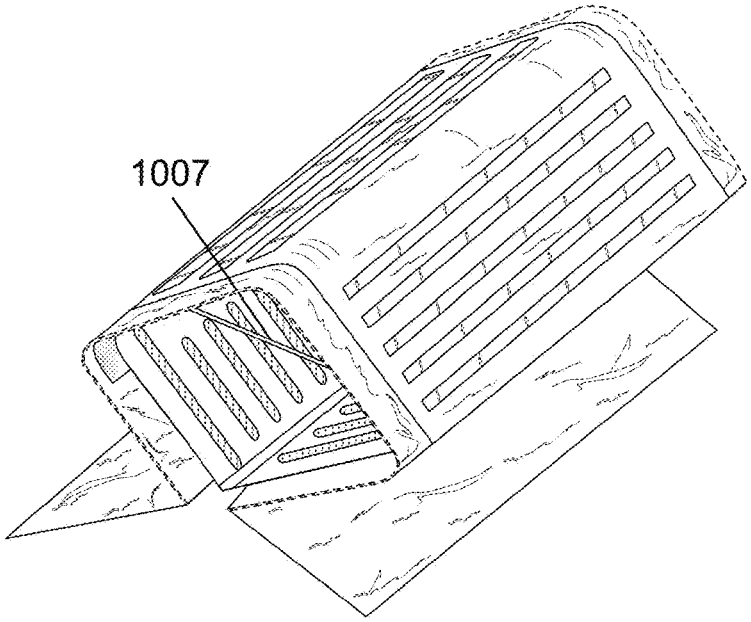
Figure 10C:
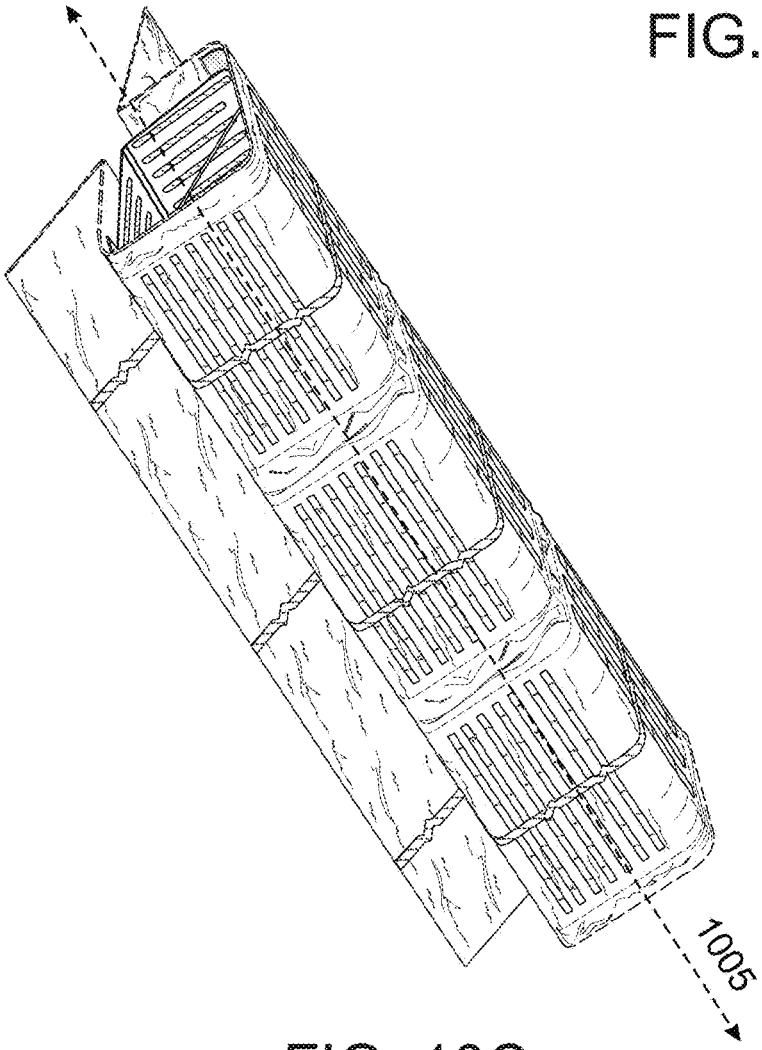

FIGS. 10A-C are a bottom view of a boom unit including a horizontally extending elastic element, in a folded state (FIG. 10A), and an expanded state (FIG. 10B); and an expanded boom sleeve (FIG. 10C) comprising units as shown in FIGS. 10A-B.

In some embodiments, a boom unit 1001 for example as shown in FIG. 10A (from a bottom view) and FIG. 10B (from an isometric view), does not include structural elongate elements (e.g. rods).

In this example, plates of an upper portion of the boom unit comprise closed air cells 1003, optionally extending in a direction parallel to a long axis of the full boom (see for example axis 1005 in FIG. 10C).

In some embodiments, at least some of the plates of a lower portion of the boom unit comprise open cells, allowing for water to flow inside them. Optionally, at least some of the plates do not include cells. In this example, plates defining the lower segments of the X shape of the lower boom portion are formed without cells.

In some embodiments, the boom unit comprises an elastic element for actuating and/or assisting self expansion of the unit from a folded state. In this example, a spring 1007 extends horizontally within the chamber.

In some embodiments, for example as described hereinabove, the boom unit is ballasted by weights and/or by water. Optionally, water enters the open cells of the lower boom unit portion and/or the hollow chamber.

FIGS. 11A-B show axially extending supporters of a boom sleeve, according to some embodiments.

In some embodiments, a boom sleeve comprises one or more axially extending supporters 1101. In some embodiments, the supporters are long enough to extend throughout the full length of the boom sleeve. In some embodiments, the supporters are coupled to the boom sleeve internally and/or externally.

In some embodiments, the supporters are attached to inner walls of the boom units 1103, and/or to an inner surface of the sheet 1105. In an example, as shown in FIG. 11B in which a vertical cross section of a boom unit is illustrated, the supporters are mounted at or adjacent opposing coupling points 1107 between the plates of the unit.

In some embodiments, the supporters are formed of a tear-resistant yet flexible material, for example Nylon, PET, and/or other materials. In some embodiments, the supporters are flexible enough so as not to interfere with relative movement of sequential boom units, so that the boom sleeve is enabled to free float without being restricted by the supporters.

In some embodiments, a supporter is formed is a strap, a rope, a cable, and/or other thin elongate element.

Potential advantages of axially extending supporters may include: providing a chaining element which contributes to maintaining the boom units connected; improving a resistance of the boom sleeve to forces acting on the boom, for example local forces which may tear or cut the sheet;

facilitating deployment and/or collecting of the boom sleeve, for example by pulling on one of ends of the supporter. In some embodiments, the supporters (e.g. straps) are attached to side handles of the boom sleeve which can be gripped by the user during removal from the package and/or deployment and/or collecting of the boom sleeve.

FIGS. 12A-E are examples of rod configurations comprising a ballasting portion, according to some embodiments.

Figure 12A:
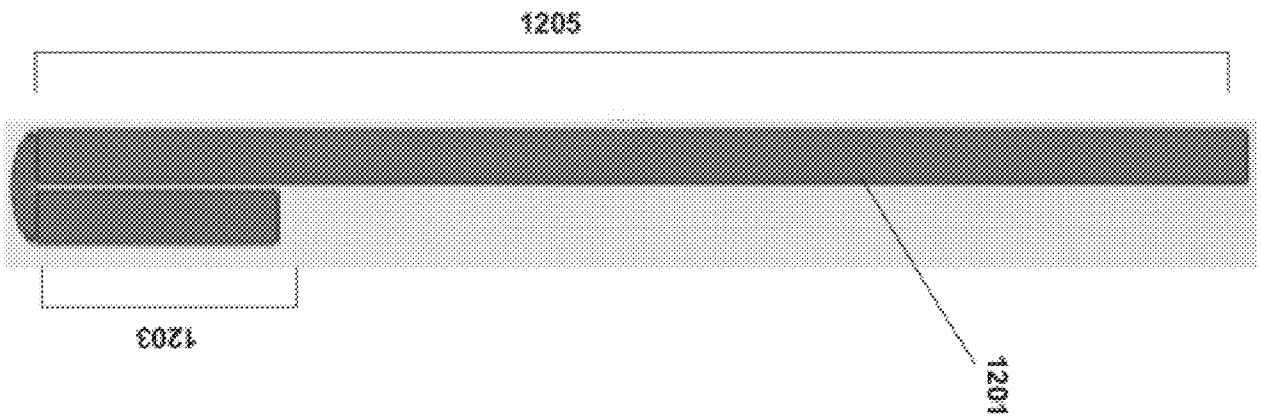
FIGS. 12A, 12B, 12C. 12D and 12E are examples of rod configurations comprising a ballasting portion, according to some embodiments.

In some embodiments, as shown for example in FIG. 12A, one or more rods 1201 of the boom unit are configured to weigh down the boom unit. In some embodiments, a rod is formed of or includes a relatively heavy material, for example metal. Additionally or alternatively, the rod including a bend or a curvature in which a short rod segment 1203 is optionally folded over another longer segment 1205 of the rod, effectively thickening the rod along a portion of its length. In some embodiments, the bend is formed at a lower portion of the rod (for example, a portion embedded in the lower part of the boom unit which is positioned underwater when the boom is deployed).

In some embodiments, segment 1203 extends along no more than 40%, no more than 30%, no more than 20% or intermediate, longer or shorter portion of a length of segment 1205.

A potential advantage of a rod comprising a segment that is folded over another may include facilitating manufacturing of the boom by reducing the need to add designated weights. Another potential advantage may include providing a ballast which has small or no interference on the boom unit structure, as the folded segment extends along the rod itself (with the rod acting as a framing element of the boom unit).

Figure 12B:
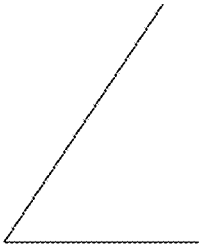
Figure 12C:
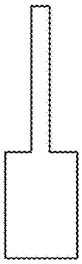
Figure 12D:
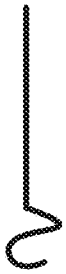
Figure 12E:
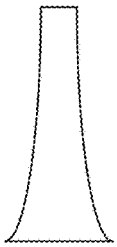

Alternative configurations of rigid elements functioning as structural support for the boom are shown in FIGS. 12B-E, where at least a portion of the element is shaped to provide increased weight. In the example of FIG. 12B, a folded L-shaped rod may be heavier at its corner; in the example of FIG. 12C, a rod comprises a wider portion (e.g. a portion or segment having a cross section larger than a cross section of other rod portions); in the example of FIG. 12D, a rod comprises an S-shaped curve or other curvature which defines a heavier segment; in the example of FIG. 12E, a rod comprises a widening (e.g. conical) profile.

In some embodiments, an element comprising a ballasting portion (e.g. a rod) for example as shown herein is located in the lower part of the boom unit. Optionally, the ballasting portion is positioned at a lowest portion of the boom unit. For example, rods having a ballasting portion are embedded and/or mounted onto plates forming the X-shape at the lower part of the boom unit, optionally under the crossing point of the X-shape.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting. In addition, any priority document(s) of this application is/are hereby incorporated herein by reference in its/their entirety.

What is claimed is:

1. A boom for containing floating material spilled in water comprising:

an elongate sheet comprising a plurality of spaced apart units, each unit configured to self-expand from a folded state upon deployment; each unit comprising:

a plurality of plates forming an upper portion and a lower portion, said upper and lower portions defined along a vertical axis of the boom unit;

wherein said lower portion includes a plurality of stiffening elongate rods positioned within at least some of said plates forming said lower portion, each of said elongate rods interconnecting at least two plates.

2. The boom according to claim 1, wherein said elongate rods extend along a vertical plane of the boom unit.

3. The boom according to claim 1, wherein plates of said lower portion of said unit are arranged to define a crossing between them, and said elongate rods pass at said crossing.

4. The boom unit according to claim 1, wherein when said boom is deployed in water, said upper portion floats above water surface and said lower portion remains substantially below water surface.

5. The boom according to claim 1, wherein said elongate rods are formed of metal and/or fiberglass.

6. The boom according to claim 1, wherein said elongate rods are arranged in a staggered configuration, aligned side by side in a folded state of said boom unit.

7. The boom according to claim 1, wherein said elongate rods are sufficiently heavy so as to at least partially ballast said boom unit.

8. The boom according to claim 1, wherein one or more of said elongate rods includes a segment which is folded over another segment of the rod, thereby increasing a weight of the rod locally at the folded segment.

9. The boom according to claim 1, wherein at least some of said plates are arranged to form a hollow chamber in an expanded state of said unit.

10. The boom according to claim 9, wherein said hollow chamber comprises a rhombus cross section shape.

11. The boom according to claim 10, wherein said elongate rods cross at a lowest point of the rhombus.

12. The boom according to claim 1, wherein each of said units comprises an elastic element positioned and configured to actuate expansion of said unit.

13. The boom according to claim 12, wherein adjacent elongate rods are configured to pivot about their crossing during expansion of said boom unit.

14. The boom according to claim 12, wherein at least some of said plates are arranged to form a hollow chamber in an expanded state of said unit; and wherein said elastic element extends between plates which define opposing faces of said hollow chamber or between opposing coupling points of adjacent plates.

15. The boom according to claim 12, wherein said elastic element is a spring.

16. The boom according to claim 12, wherein said elastic element is extended at a folded state of said boom unit and returns to a natural rest state at an expanded state of said boom unit.

17. The boom according to claim 16, wherein expansion of said upper portion by said elastic element causes movement of said elongate rods relative to each other.

18. The boom according to claim 1, wherein each of said upper portion plates comprises one of: an array of sealed, pre-filled air cells and closed cell sponge.

19. The boom according to claim 18, wherein each of said upper portion plates comprises an array of sealed, pre-filled air cells, wherein said sealed air cells are in the form of a closed-cell foam or in the form of pre-filled welded cells.

20. The boom according to claim 1, wherein said elongate rods are at least partially embedded or mounted onto said lower portion plates.

21. The boom according to claim 1, wherein said lower portion further comprises a plurality of weights.

22. The boom according to claim 1, comprising one or more axially extending supporters which pass along a length of said elongate sleeve, wherein said one or more axially extending supporters comprise flexible, tear-resistant straps.

23. A method for containing floating material spilled in water comprising:

detecting a spill;

providing a boom sleeve comprising a plurality of units, each unit comprising an upper portion and a lower portion, said lower portion comprising stiffening elongate rods positioned within at least some of said plates forming said lower portion, each of said elongate rods interconnecting at least two plates;

deploying said boom sleeve to surround said spill; said deploying comprising allowing each unit to self-expand in response to spring-based actuation which expands said upper portion, thereby causing expansion of said lower portion.

24. The method according to claim 23, wherein said stiffening elongate rods extend to a coupling point with a plurality of plates of said upper portion, so that when said spring based actuation moves plates of said upper portion, said rods are moved in response.

25. The method according to claim 23, wherein following deployment of said boom sleeve each of said units remains afloat by a plurality of sealed air cells, and ballasted by one or more of: weights, water entering open cells and/or chambers of the boom.

26. A boom for containing floating material spilled in water comprising:

an elongate sheet comprising a plurality of spaced apart units, each unit configured to self-expand from a folded state upon deployment; each unit comprising:

a plurality of plates forming an upper portion and a lower portion, said upper and lower portions defined along a vertical axis of the boom unit; and a plurality of stiffening elongate rods, each of said elongate rods interconnecting at least two plates;

wherein said elongate rods are arranged in a staggered configuration, aligned side by side in a folded state of said boom unit.

27. A boom for containing floating material spilled in water comprising:

an elongate sheet comprising a plurality of spaced apart units, each unit configured to self-expand from a folded state upon deployment; each unit comprising:

a plurality of plates forming an upper portion and a lower portion, said upper and lower portions defined along a vertical axis of the boom unit; and a plurality of stiffening elongate rods, each of said elongate rods interconnecting at least two plates;

wherein one or more of said elongate rods includes a segment which is folded over another segment of the rod, thereby increasing a weight of the rod locally at the folded segment.

* * * * *